US008408148B2

(12) United States Patent
Digdon

(10) Patent No.: US 8,408,148 B2
(45) Date of Patent: Apr. 2, 2013

(54) INCREASING THE EFFICIENCY OF COMBUSTION PROCESSES

(75) Inventor: William T. Digdon, Amherst (CA)

(73) Assignee: Atlantic Combustion Technologies Inc., Amherst, Nova Scotia (CA)

( * ) Notice: Subject to any disclaimer, the term of this patent is extended or adjusted under 35 U.S.C. 154(b) by 1049 days.

(21) Appl. No.: 12/295,536

(22) PCT Filed: Mar. 30, 2007

(86) PCT No.: PCT/CA2007/000520

§ 371 (c)(1),
(2), (4) Date: Mar. 3, 2009

(87) PCT Pub. No.: WO2007/112561

PCT Pub. Date: Oct. 11, 2007

(65) Prior Publication Data

US 2009/0186309 A1 Jul. 23, 2009

Related U.S. Application Data

(60) Provisional application No. 60/788,668, filed on Mar. 31, 2006.

(51) Int. Cl.
*F23J 3/00* (2006.01)

(52) U.S. Cl. ..... 110/344; 110/342; 110/345; 110/347; 431/3; 44/641

(58) Field of Classification Search ..... 110/342, 110/344, 345, 347; 431/3; 44/641
See application file for complete search history.

(56) References Cited

U.S. PATENT DOCUMENTS

| | | | | | |
|---|---|---|---|---|---|
| 3,628,925 | A * | 12/1971 | Milner | 431/4 |
| 3,630,696 | A * | 12/1971 | Milner et al. | 431/8 |
| 3,738,819 | A * | 6/1973 | Milner et al. | 431/8 |
| 4,159,683 | A * | 7/1979 | Hughes et al. | 110/343 |
| 4,397,428 | A * | 8/1983 | Smith | 242/573.9 |
| 4,438,709 | A * | 3/1984 | Borio et al. | 110/347 |
| 4,480,560 | A * | 11/1984 | Lennon | 110/342 |
| 4,773,919 | A * | 9/1988 | Sauter et al. | 48/202 |
| 5,607,496 | A * | 3/1997 | Brooks | 75/670 |
| 5,695,726 | A * | 12/1997 | Lerner | 423/210 |
| 6,284,208 | B1 * | 9/2001 | Thomassen | 423/210 |
| 7,048,781 | B1 * | 5/2006 | Lovell | 95/134 |
| 7,052,532 | B1 * | 5/2006 | Liu et al. | 96/154 |
| 8,124,036 | B1 * | 2/2012 | Baldrey et al. | 423/99 |
| 2007/0122327 | A1 * | 5/2007 | Yang et al. | 423/210 |

FOREIGN PATENT DOCUMENTS

| | | |
|---|---|---|
| EP | 0 958 335 B1 | 11/1999 |
| WO | WO 98/03616 | 1/1998 |

OTHER PUBLICATIONS

Noemi M. Nagy and Jozsef Konya, "Acid-Base Properties of Bentonite Rocks with Different Origins", Jun. 16, 2005, Science Direct, 11-pages.*

Walter R. Niessen, "Combustion and Incineration Processes", 2002, Marcel Dekker, Inc., Third Eddition.*

Written Opinion and International Search Report PCT/CA2007/000520 dated Jul. 13, 2007.

* cited by examiner

*Primary Examiner* — Kenneth Rinehart
*Assistant Examiner* — Bao D Nguyen
(74) *Attorney, Agent, or Firm* — Winston & Strawn LLP

(57) ABSTRACT

The invention provides a method of increasing the efficiency of a combustion process by adding bentonite to the flame, fireball or burner region combustion zone of the combustion process. Also provided is a combustion chamber that includes a bentonite feed system and a fuel additive composition of a bentonite such as sodium bentonite having a particle size range that may be employed in the method of the present invention.

18 Claims, 16 Drawing Sheets

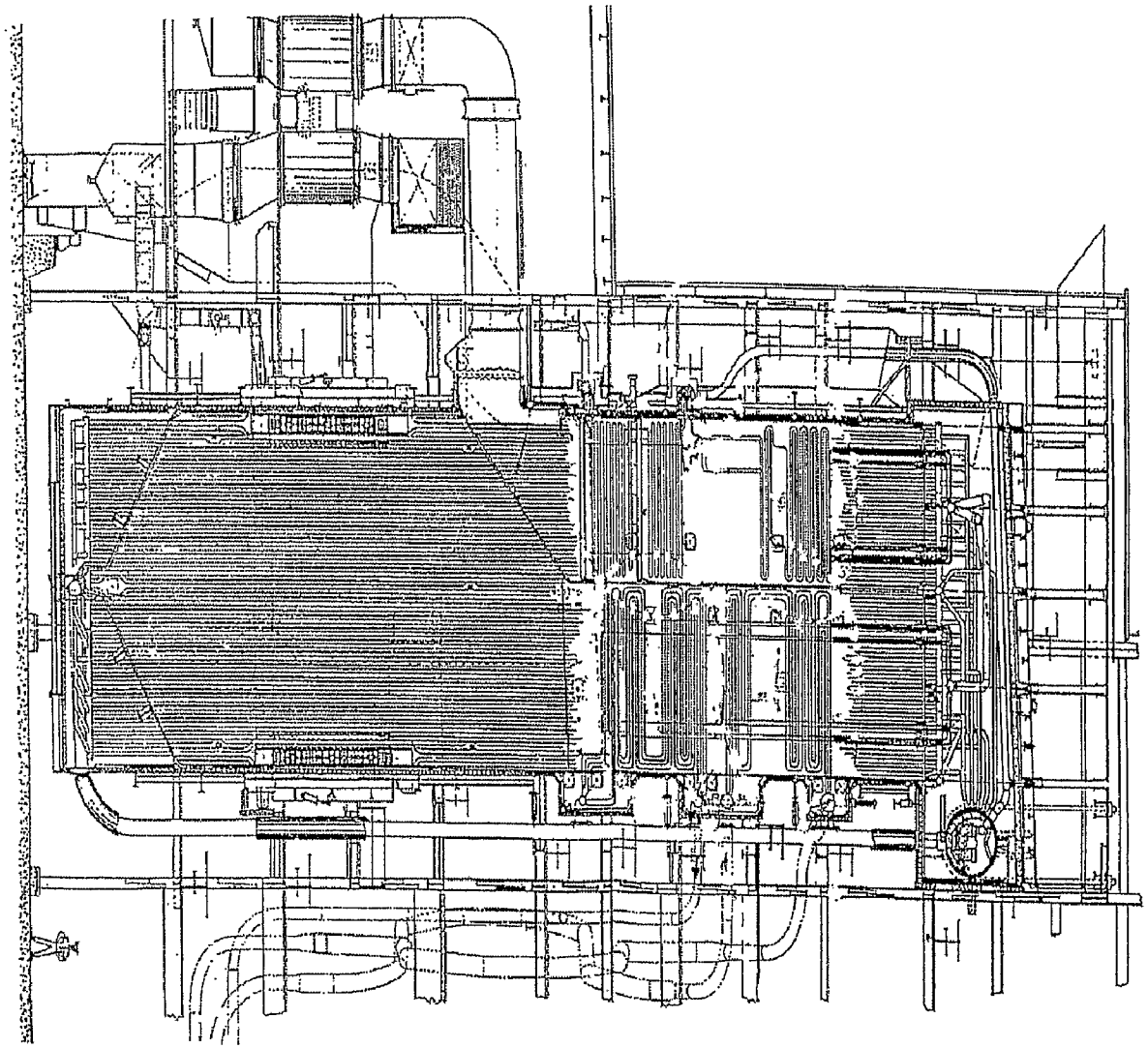
Figure 1 Boiler Arrangement

Figure 2 Net Unit Heat Rate versus Load
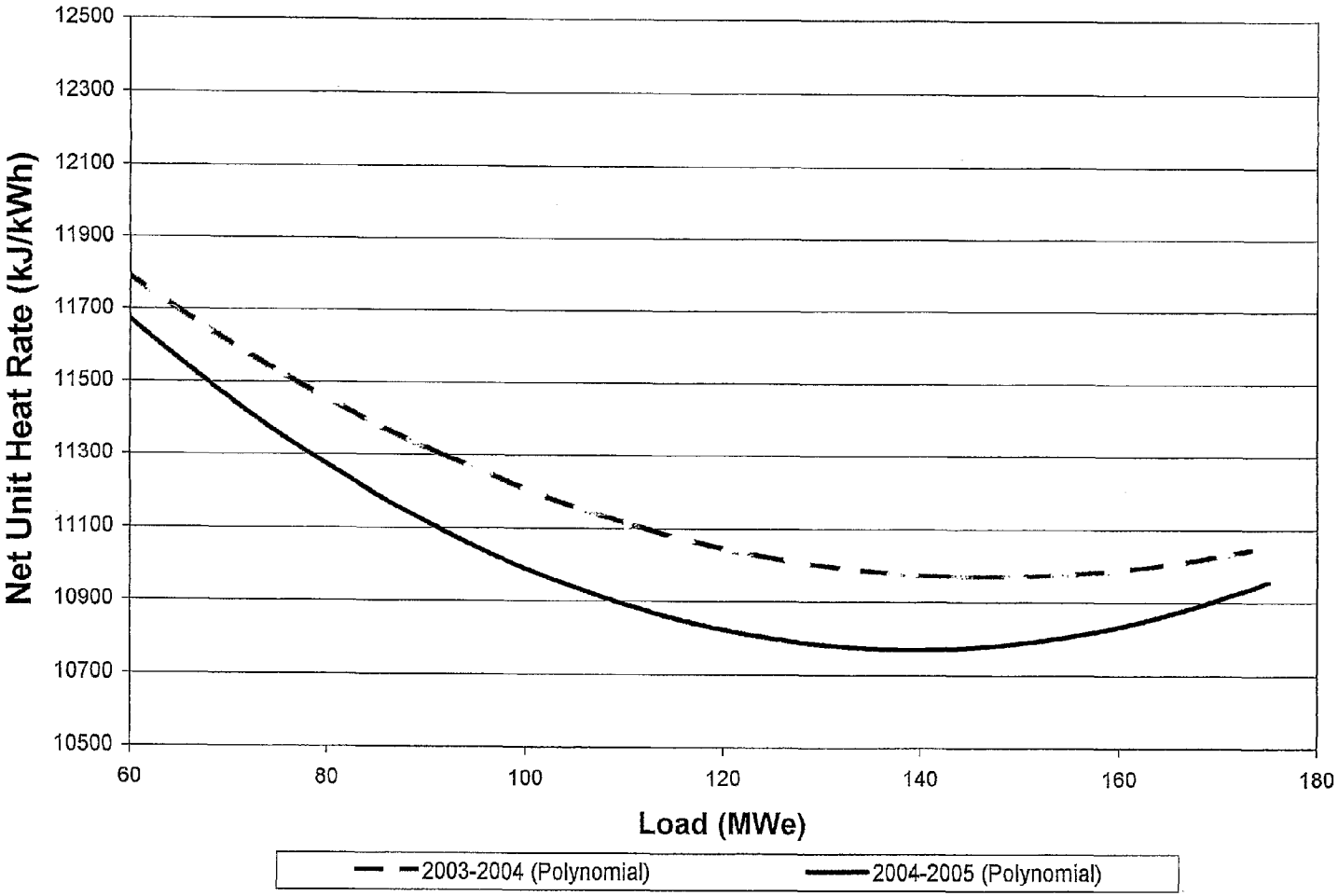

Figure 3 Fuel consumption versus load
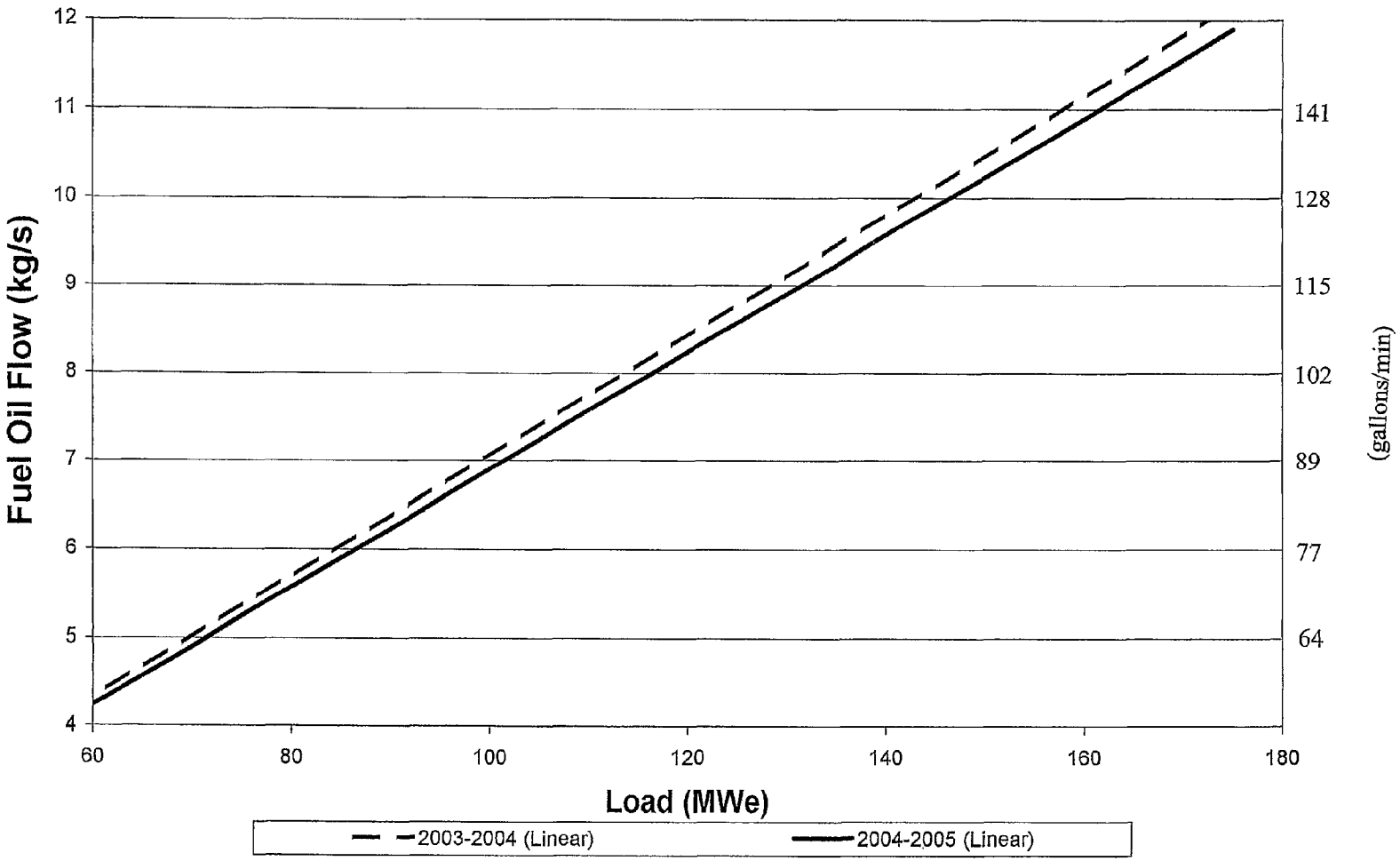

Figure 4 Hot reheat steam temperature versus time
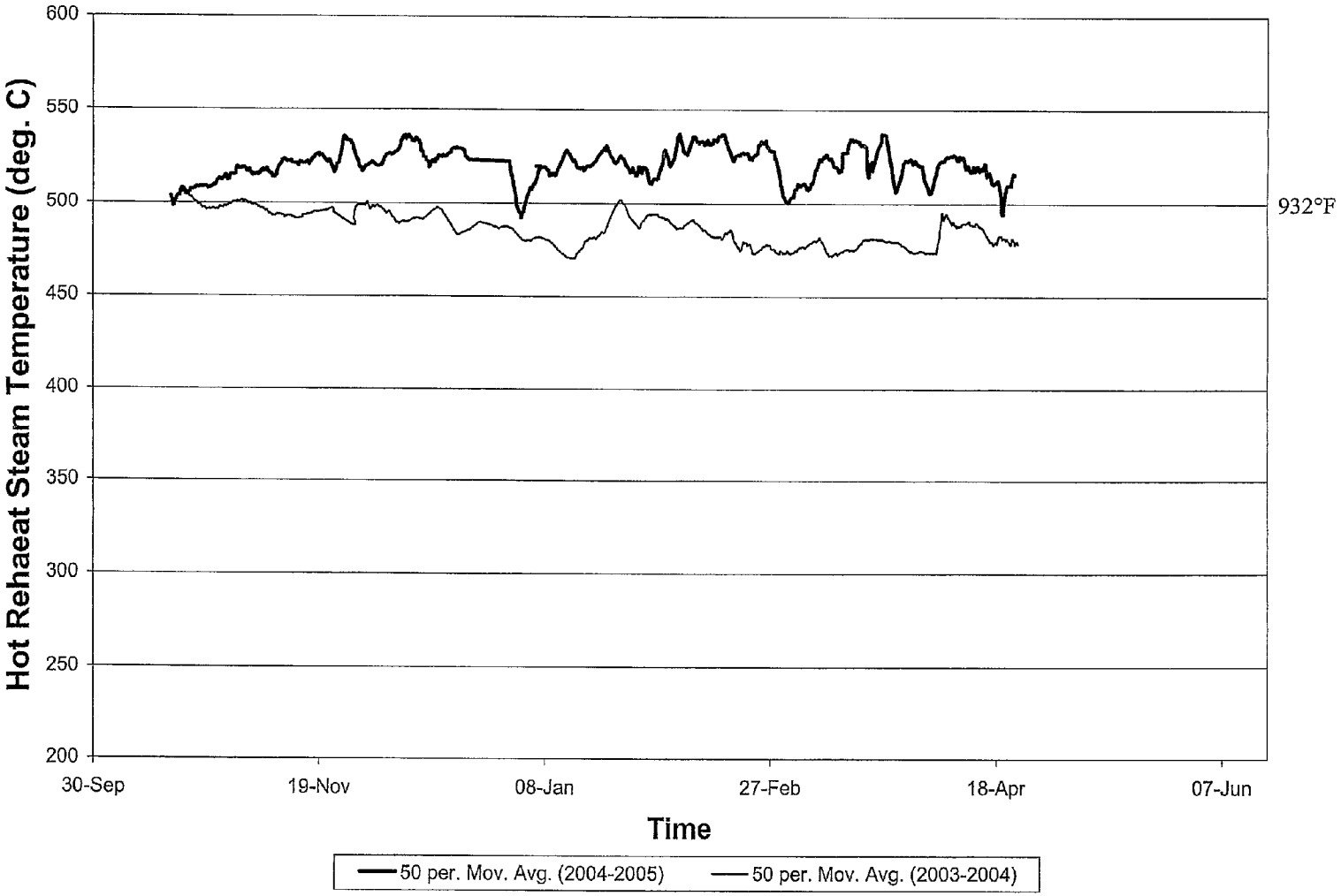

Figure 5 Hot reheat steam temperature versus load
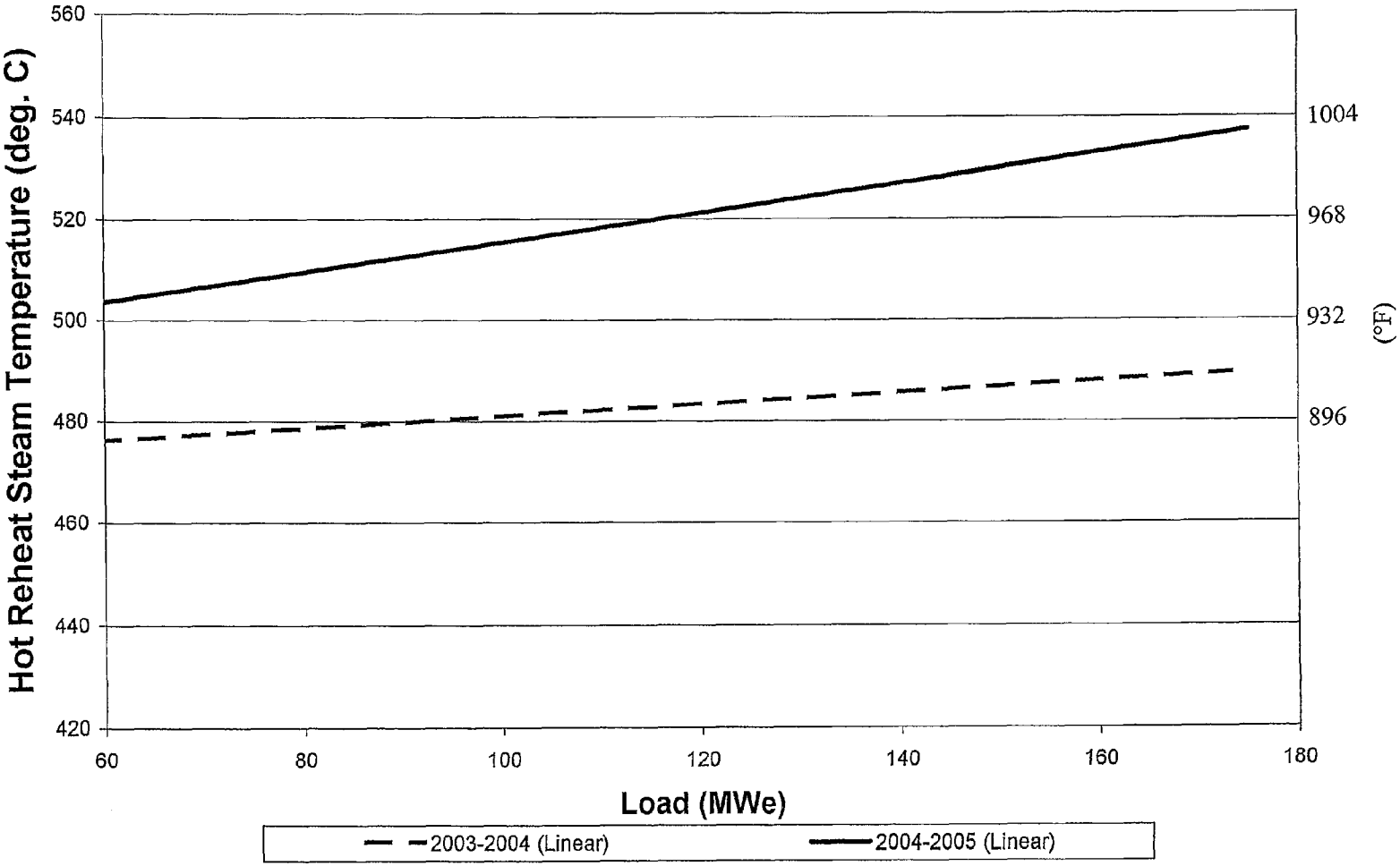

Figure 6 Furnace pressure versus load
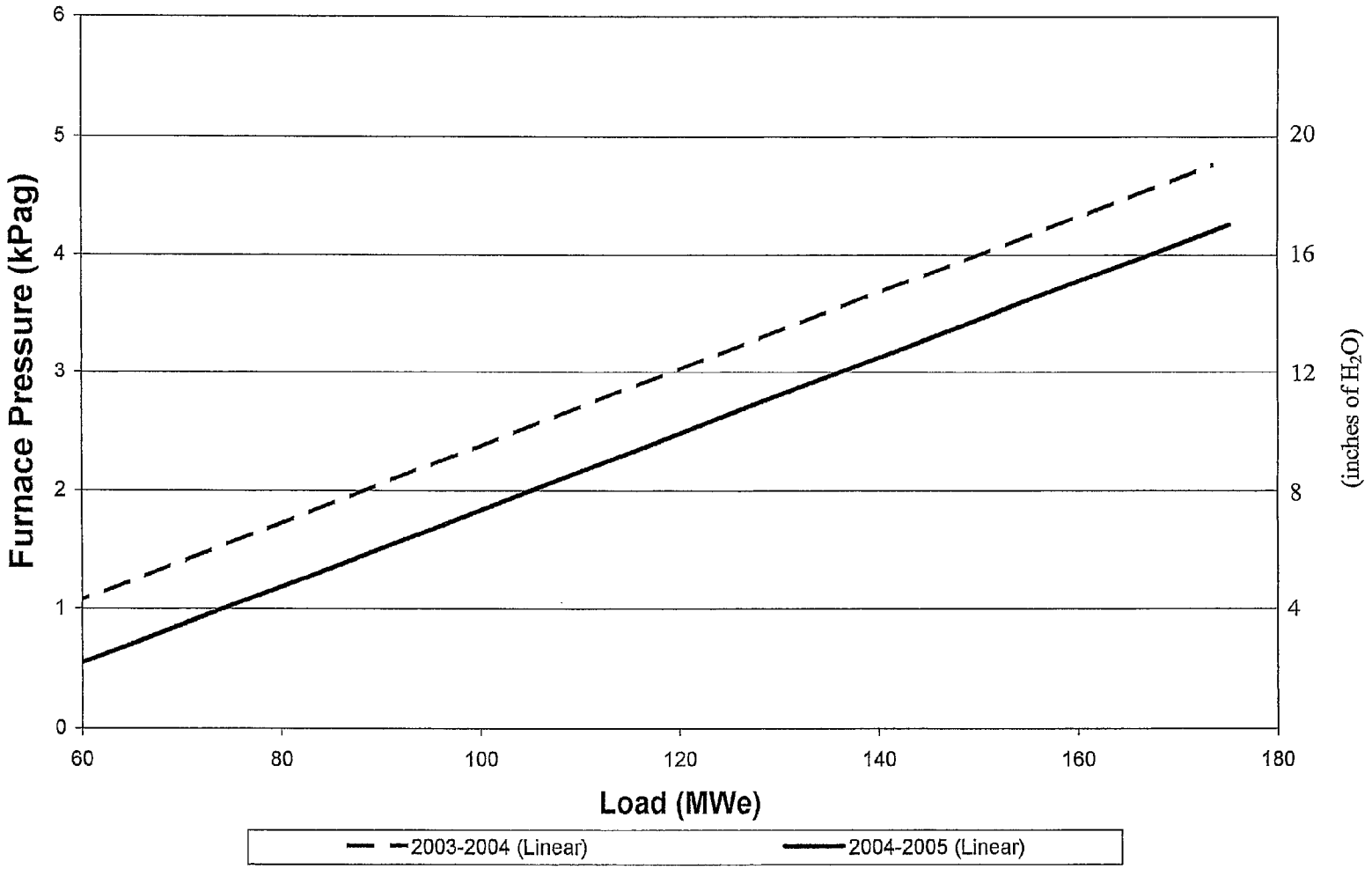

Figure 7 Pressure drop furnace to economizer inlet
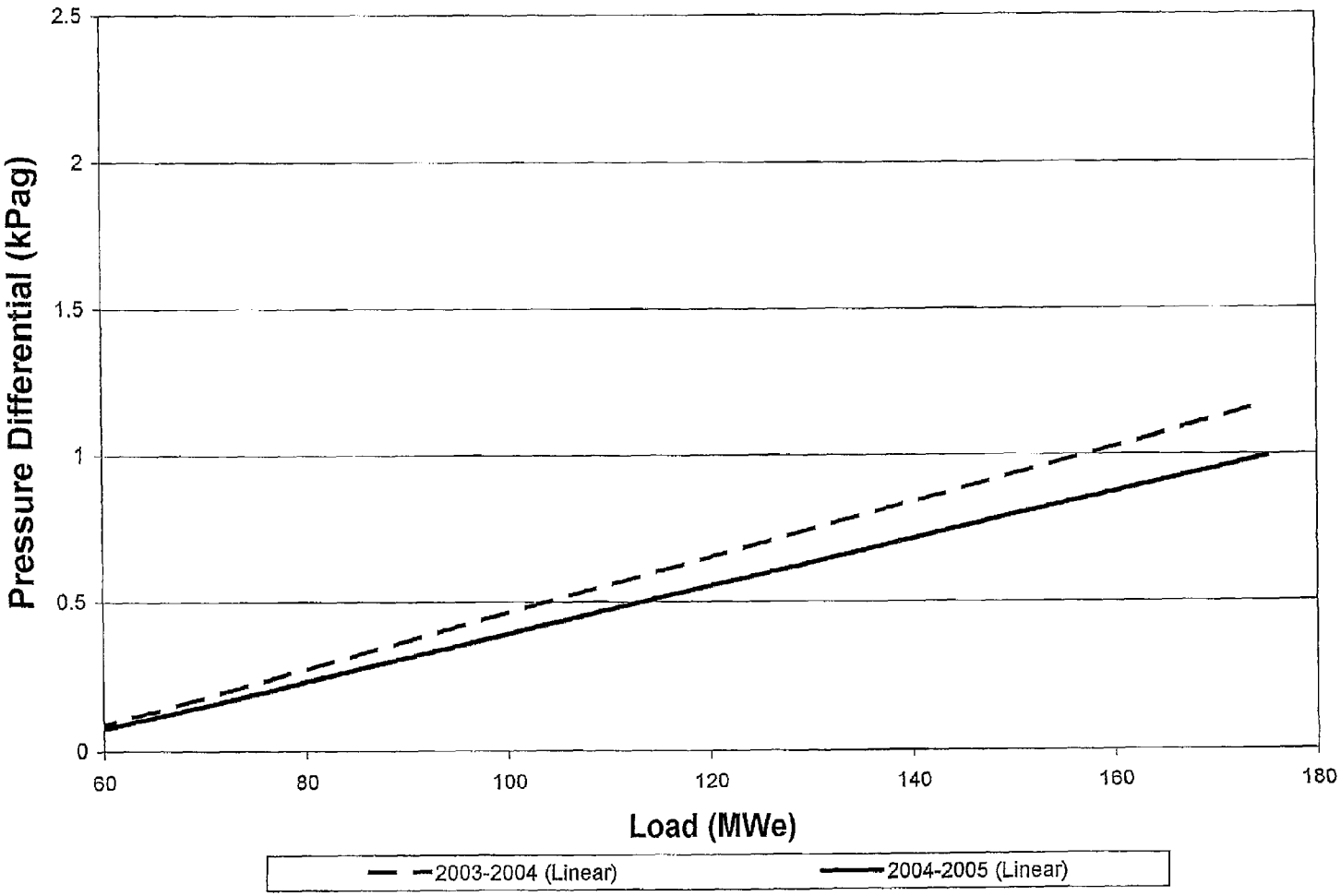

Figure 8 Economizer pressure drop versus load
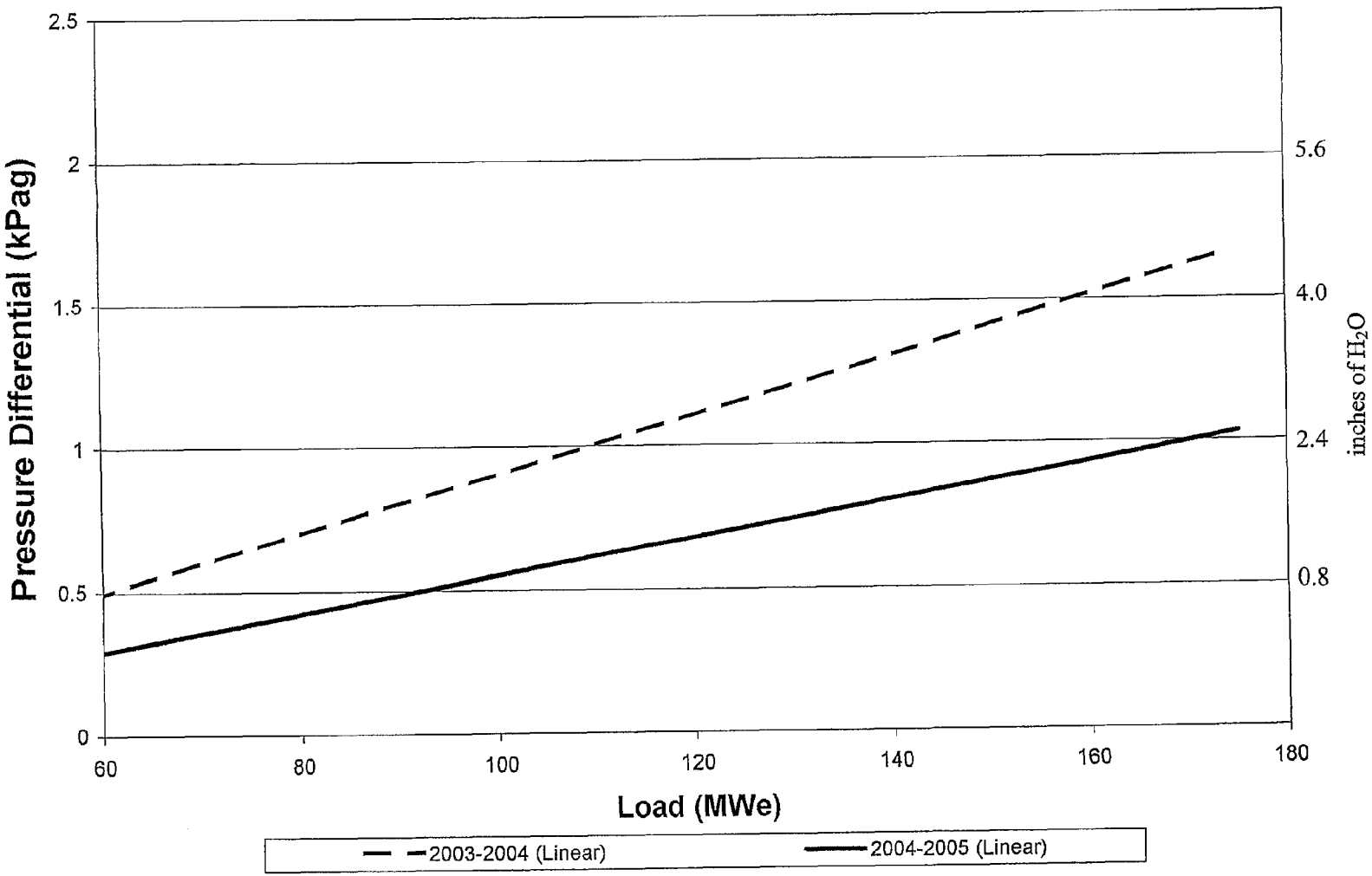

Figure 9 Air Heater pressure differential versus Load
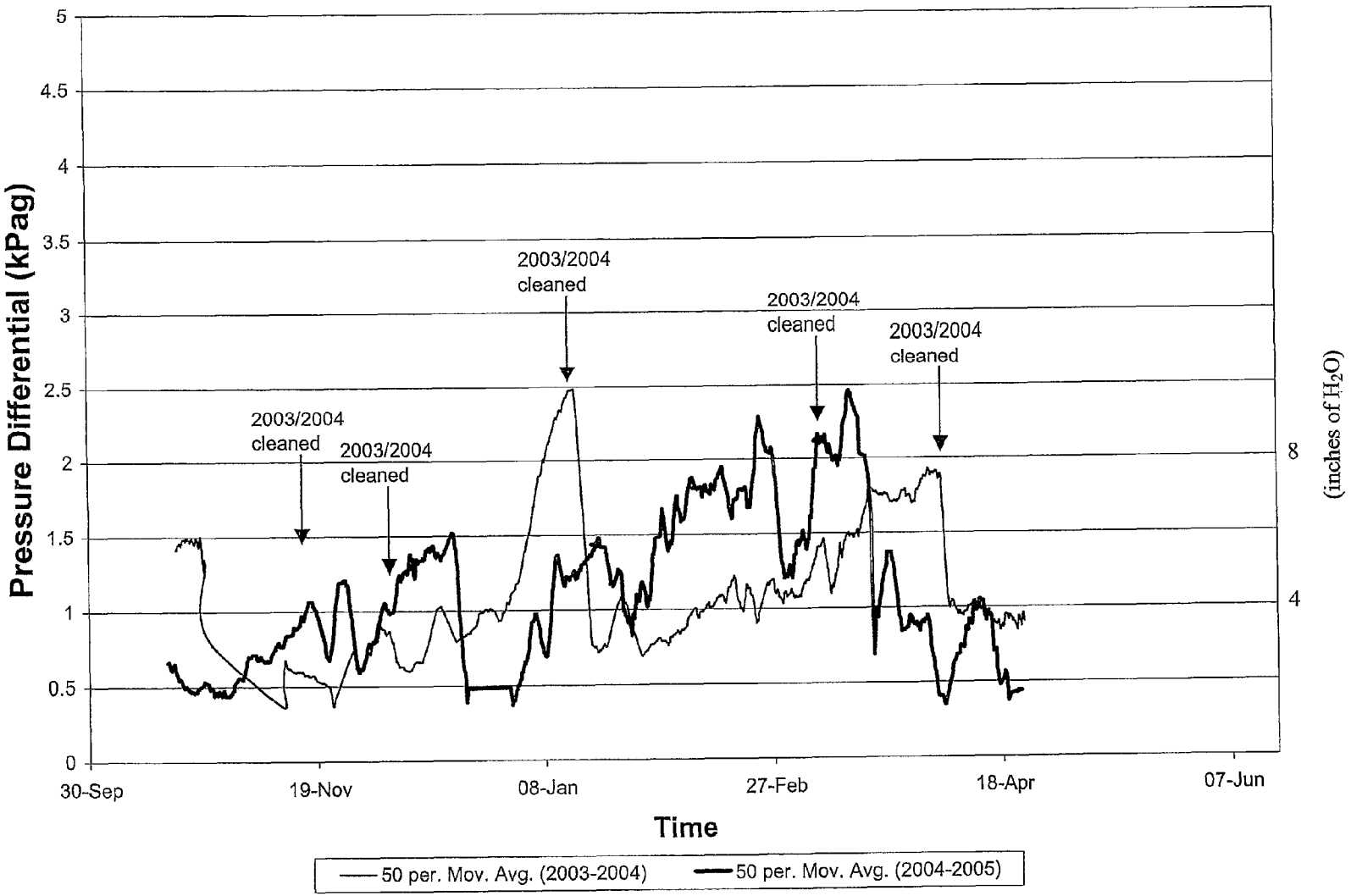

Figure 10 Boiler pressure drop versus Load
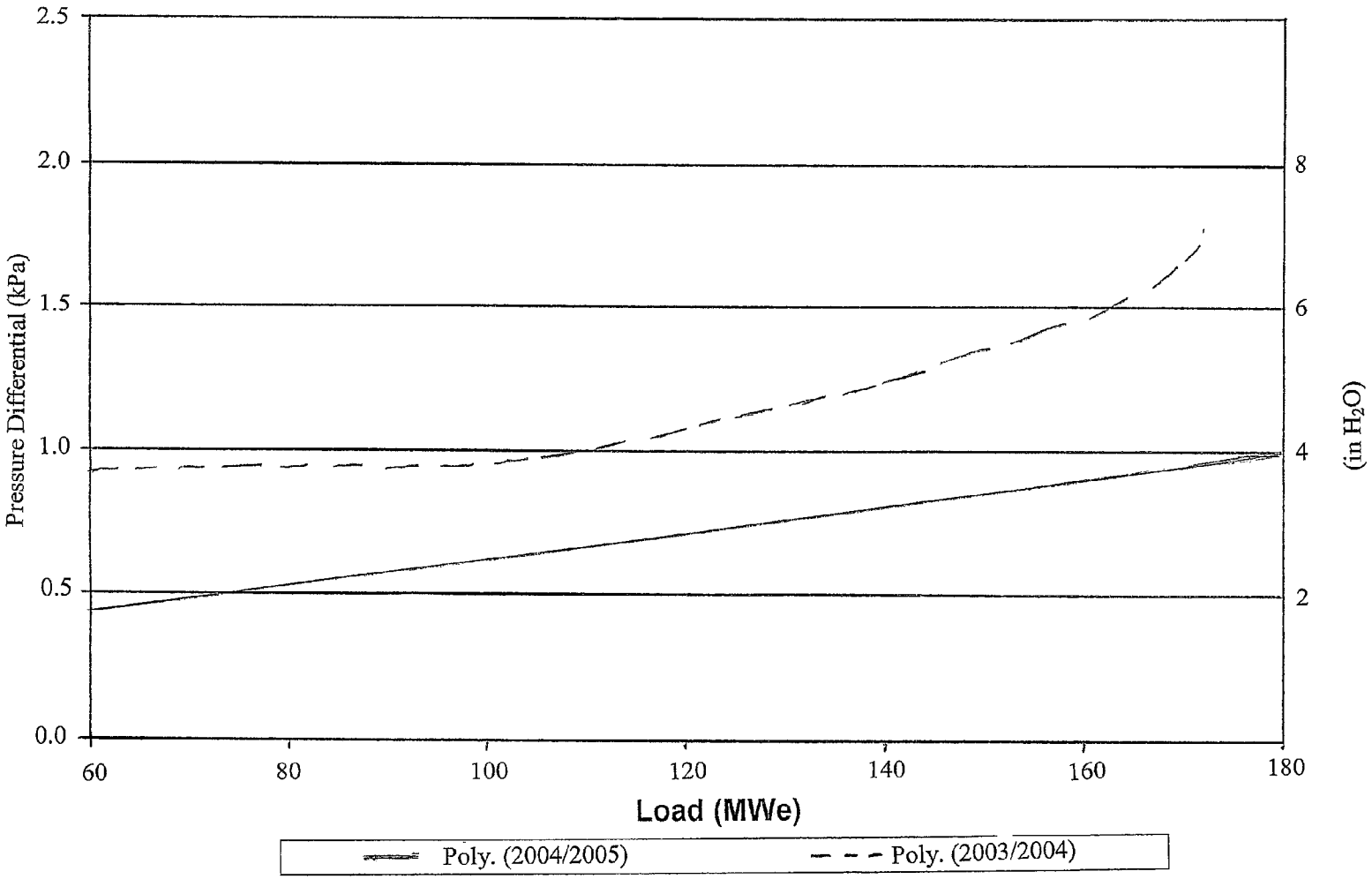

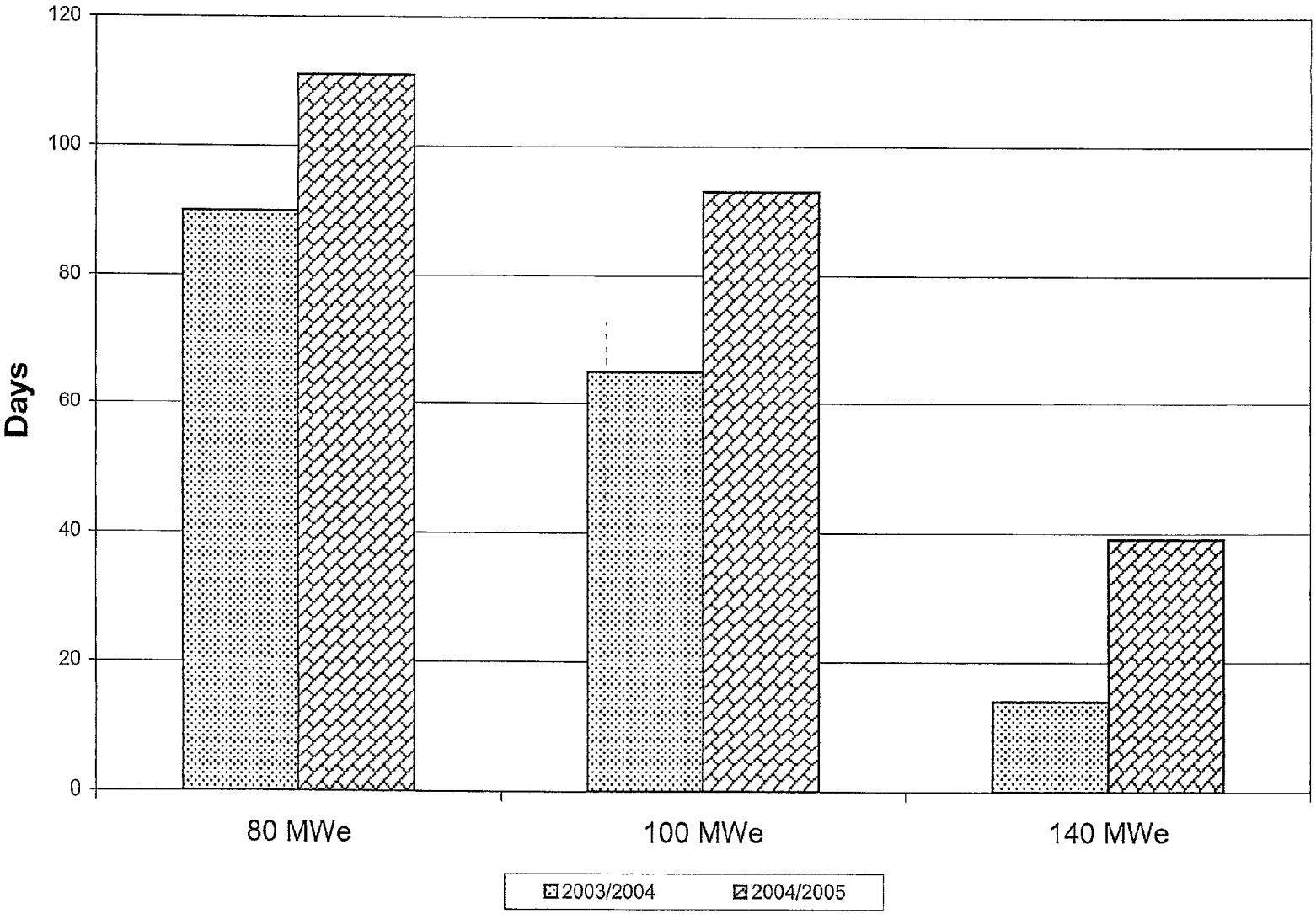
Figure 11 Number of day above 80, 100 and 140 MWe

Figure 12 Boiler efficiency versus Load
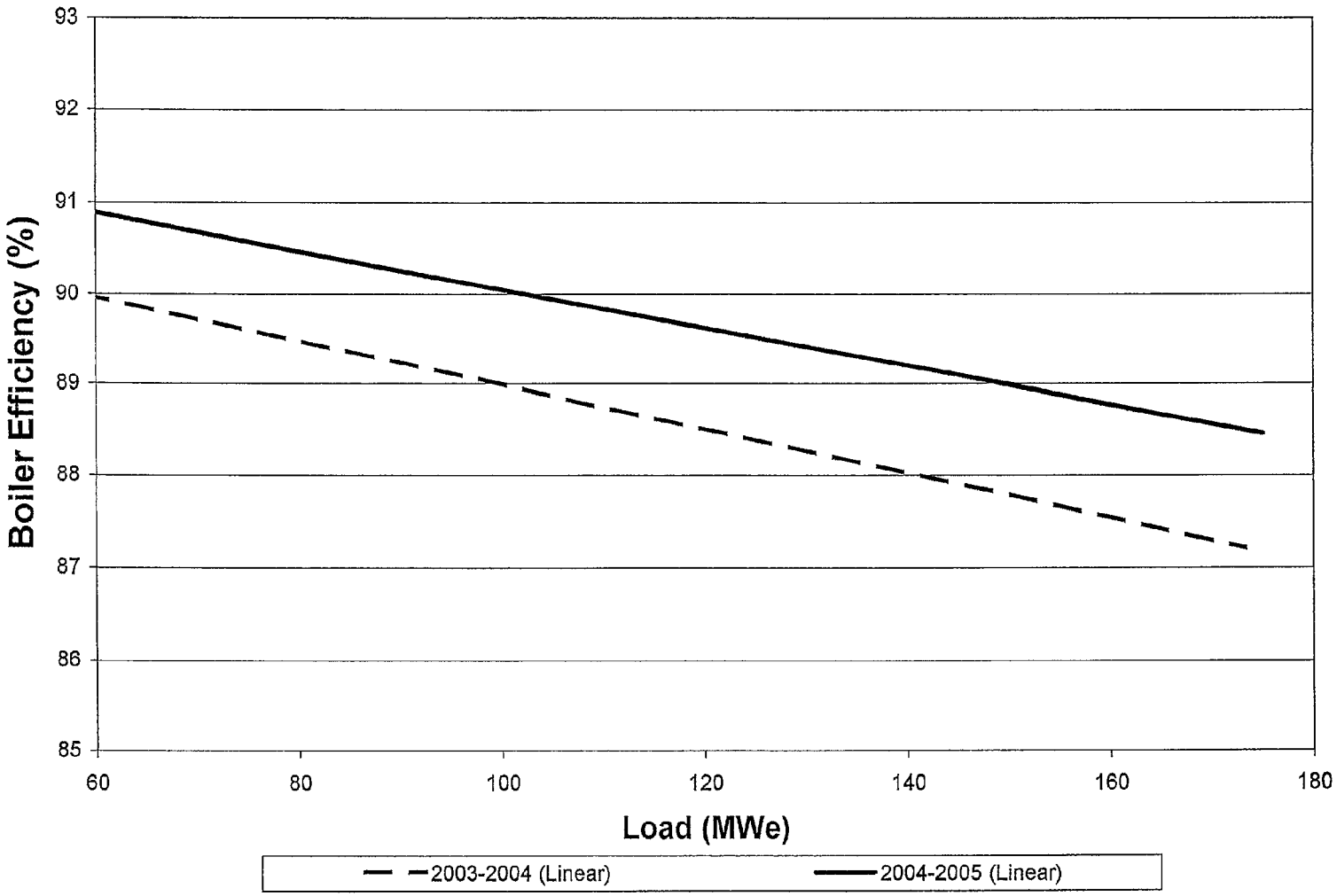

Figure 13 Conversion Factor and Total Power Produced
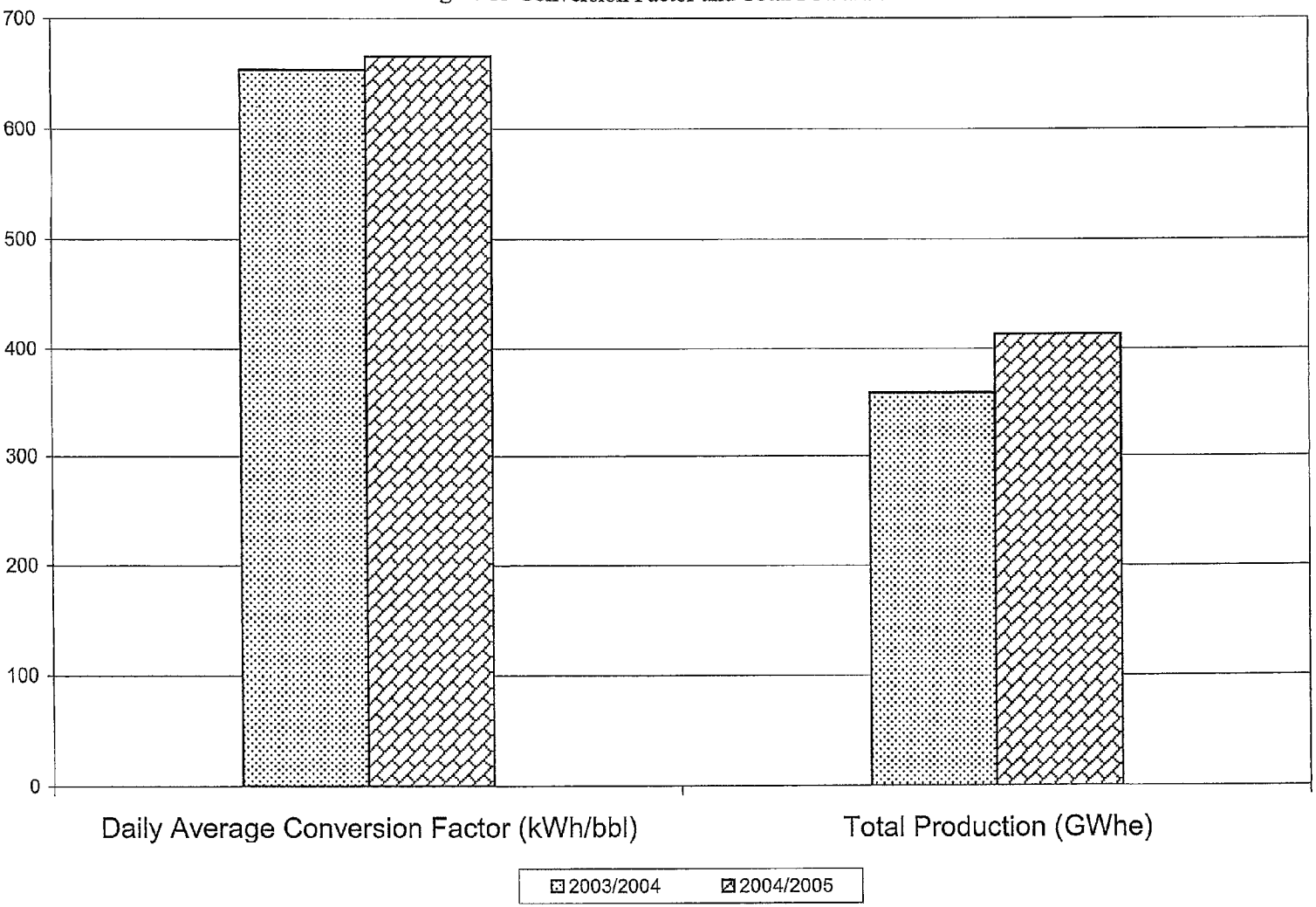

Figure 14a Comparison of Average Heat Rate
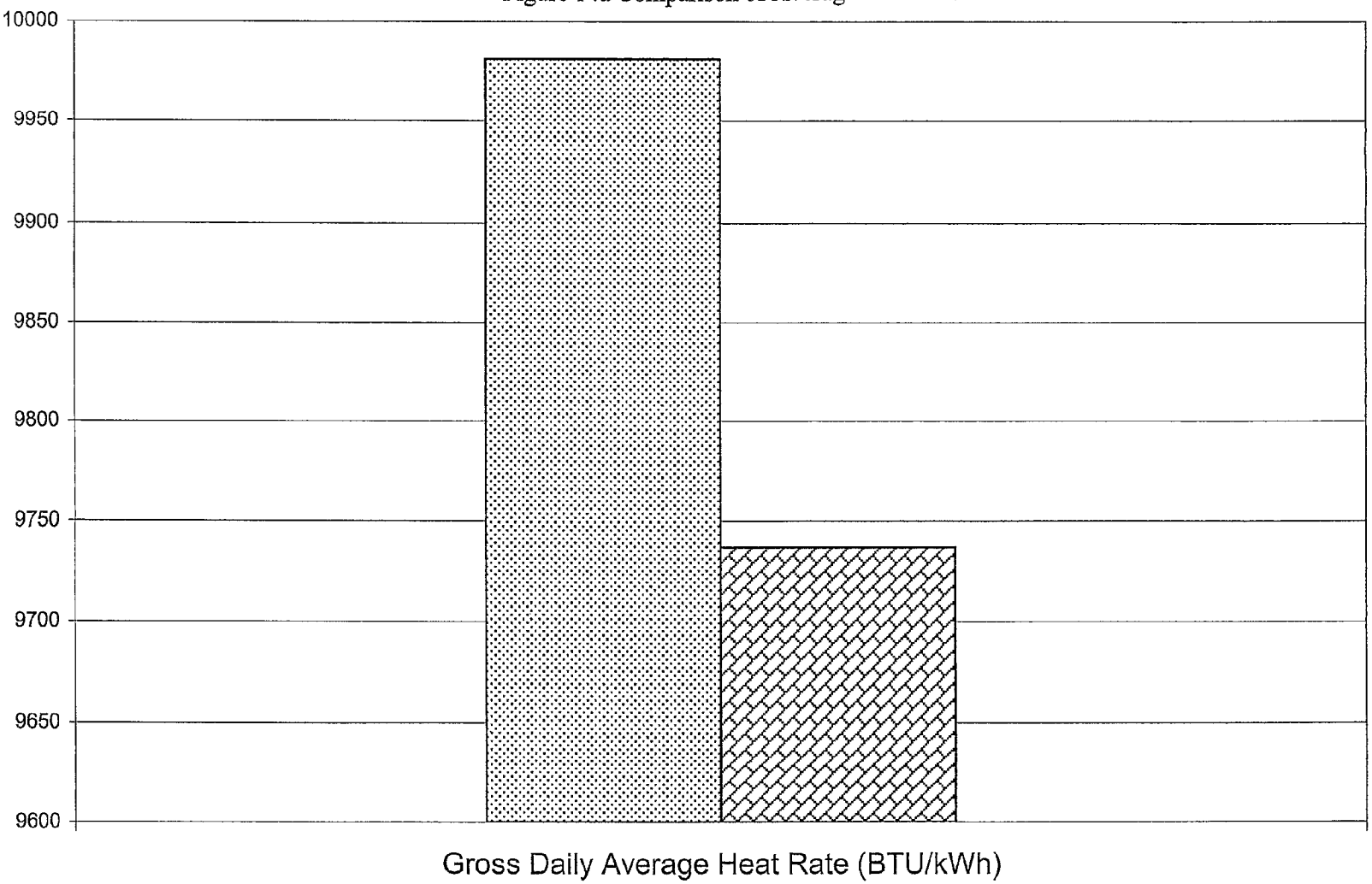

Schematic of rotary kiln facility

INCREASING THE EFFICIENCY OF COMBUSTION PROCESSES

This application is a 371 filing of International Patent Application PCT/CA2007/000520 filed Mar. 30, 2007, which claims the benefit of application No. 60/788,668 filed Mar. 31, 2006.

The present invention relates to combustion processes. More specifically, the present invention relates to methods of increasing the efficiency of a combustion process.

BACKGROUND OF THE INVENTION

It is known in the art that most common fuels contain some non-combustible impurities. The amount is generally negligible in refined fuels such as natural gas and distillate oils and may be less than about 1% in some residual oils. The solid state non-combustibles in fuel are referred to as mineral matter, whereas the material remaining after combustion is known as ash. Combustion processes that employ fuels comprising a relatively large amount of mineral matter may suffer from problems such as slagging, fouling and corrosion of the combustion chamber and associated components. In such processes, there has been much research into chemicals and additives that can correct or alleviate the problems. One such additive is bentonite.

Bentonite is a natural clay of the smectite family consisting primarily of montmorillonite, a hydrous aluminum silicate comprising a unit cell structure Si—Al—Si, and comprising a plurality of ionic materials. There are many different types of bentonites differing primarily in the type of ionic materials that are associated with molecular structure of the material. The crystalline lattice of most clays may have a portion of the aluminum atoms replaced with other metals in minor amounts including iron, zinc, nickel, lithium, calcium, sodium, magnesium and iron. For example, sodium bentonite and calcium bentonite differ by the amount of sodium and calcium cations replacing aluminum in the montmorillonite crystalline lattice. The differences in the molecular makeup between bentonites account for the wide variation in the molecular properties of these materials. For instance, sodium bentonite swells considerably in water whereas calcium bentonite does not. These differences also account for the variation in the industrial use of these materials. For example, certain bentonites may be used as a bonding material in the preparation of molding sand for the production of iron and steel castings, as a binding agent in the production of iron ore pellets, as a thixotropic material and lubricating agent in filling and drilling applications and also as a clumping agent in cat litter.

U.S. Pat. No. 4,159,683 discloses a method of reducing slag and soot formed from combustion of carbonaceous waste materials in furnaces by adding a small amount of sodium bentonite to the carbonaceous waste (fuel) of the combustion process.

U.S. Pat. No. 3,628,925 discloses a method of promoting combustion and reducing slag deposition, by including an adjuvant comprising calcium based montmorillonite clay with a hydrocarbon fuel.

U.S. Pat. No. 3,738,819 discloses the use of a combustion adjuvant comprising a calcium based montmorillonite clay, a phosphate and a source of boron oxide combined with a hydrocarbon fuel in a combustion zone.

There is a need in the art to increase the efficiency of combustion processes.

SUMMARY OF THE INVENTION

The present invention relates to methods for modifying combustion processes. More specifically, the present invention relates to methods of increasing the efficiency of a combustion process.

According to the present invention, there is provided a method of increasing the efficiency of a combustion process comprising the step of adding bentonite to the flame, fireball or burner region combustion zone during combustion of a fuel. According to an alternate embodiment, there is provided a method of increasing the efficiency of a combustion process comprising the step of adding bentonite, for example, but not limited to sodium bentonite to the flame, fireball or burner region combustion zone during combustion of a low mineral fuel.

The present invention also provides a method as defined above, wherein the low mineral fuel comprises less than about 1% mineral content.

Also provided by the present invention is a method as defined above wherein the bentonite is added to the flame, fireball or burner region combustion zone in a combustion chamber, boiler, kiln or furnace. The fuel and the bentonite may be added separately in the combustion process or they may be added together.

Also provided by the present invention is a method of increasing the efficiency of a combustion process as defined above wherein the fuel is natural gas, distillate oil, residual oil, heavy oil or any combination thereof.

The present invention further contemplates a method as defined above wherein the bentonite is a sodium bentonite. In an embodiment, the bentonite may comprise the following characteristics determined by X-ray fluorescence:

| Component | Wt % |
|---|---|
| $SiO_2$ | from about 51 to about 78% |
| $Al_2O_3$ | from about 13 to about 27% |
| $Fe_2O_3$ | from about 1 to about 5% |
| MgO | from about 1 to about 3% |
| CaO | from about 0.1 to 3.0% |
| $Na_2O$ | from about 1 to about 3% |
| $K_2O$ | from about 0 to about 2% |
| TiO | from about 0 to about 0.5% |
| FeO | from about 0 to about 0.5%. |

In a further embodiment, the bentonite composition comprises the characteristics as defined below:

| Consitituent | Approx % by weight |
|---|---|
| $SiO_2$ | 60-66 |
| $Al_2O_3$ | 19-22 |
| $Fe_2O_3$ | 3-4 |
| $TiO_2$ | 0.10-0.2 |
| $P_2O_5$ | 0.03-0.08 |
| CaO | 0.4-1 |
| MgO | 1.7-2.5 |
| $SO_3$ | 0.5-0.9 |
| $Na_2O$ | 1.3-2.5 |
| $K_2O$ | 0.3-0.6 |
| BaO | 0-0.05 |
| SrO | 0.01-0.04 |
| $V_2O_5$ | <0.03 |
| NiO | 0-0.09 |
| MnO | 0.005-0.02 |
| $Cr_2O_3$ | <0.01 |
| Loss, fusion | 0-15 |

The method of the present invention as defined above further contemplates using a bentonite composition that comprises a particle size of between about 50 mesh and about 350 mesh, for example about 50, 75, 90, 100, 125, 150, 175, 200, 225, 250, 275, 300, 325, 350 mesh or any value therebetween. In a preferred embodiment, the bentonite is about 150 mesh (approx. 100 microns). However, it is to be understood that the present invention also contemplates using bentonite compositions comprising a size smaller than about 350 mesh. In a specific embodiment, which is not meant to be limiting, the present invention contemplates using bentonite with a particle size of about 50 microns. In an alternate embodiment, a particle size of 10 microns may be employed.

Without wishing to be limiting in any manner, the method of the present invention as defined above also contemplates a bentonite feed rate to fuel feed rate in the range of about 1:500 to about 1:2, more preferably about 1:100 to about 1:5. The actual rate may be defined by any other ratio within the range. In an alternate embodiment, which is also not meant to be limiting in any manner, the amount of bentonite may be defined by a range of about 2 lbs/hour to 125 pounds/hr per 150 Mwatts capacity of a power utility boiler.

Also contemplated is the method as defined above, wherein the bentonite comprises a base/acid (B/A) ratio of between about 0.08 and 0.12.

The present invention further provides a method as defined above wherein the bentonite is added to the flame, fireball or burner region combustion zone by screw auger with pneumatic feed, venturi tube or any other suitable delivery system or combination of systems.

The present invention also contemplates a combustion chamber comprising a bentonite feeding system wherein bentonite can be added to the flame, fireball or burner region combustion zone of a combustion process. The combustion chamber may comprise a boiler, furnace or kiln. In a preferred embodiment the combustion chamber is a utility boiler.

Also contemplated by the present invention is bentonite comprising a particle size of about 150 mesh.

This summary of the invention does not necessarily describe all necessary features of the invention but that the invention may also reside in a sub-combination of the described features.

BRIEF DESCRIPTION OF THE DRAWINGS

These and other features of the invention will become more apparent from the following description in which reference is made to the appended drawings. In the figures listed below (2004-2005) refers to the time period in which bentonite was added to the flame, fireball or burner region combustion zone of a combustion process. (2003-2004) refers to the time period in which a magnesium-based additive was added to the flame, fireball or burner region combustion zone of a combustion process. At no time did the concurrent addition of bentonite and magnesium-based additive occur. Also, in the figures listed below the term poly is meant to denote that the data obtained may be fit to a polynomial equation whereas the term linear is meant to denote that the data obtained may be fit to a linear equation.

FIG. 1 shows a representative drawing of a boiler cross section and its components.

FIG. 2 shows a graphical depiction of the Net Unit Heat Rate (NUHR) as a function of boiler load for a combustion process wherein bentonite is added to the flame versus a combustion process wherein a Mg-based additive is added to the flame.

FIG. 3 shows graphically the difference in fuel consumption (kg/s) as a function of load for a combustion process employing a Mg-based additive versus a combustion process employing bentonite addition to the flame.

FIG. 4 shows graphically the reheat steam temperature versus time for a combustion process wherein bentonite or a Mg-based additive is added to the flame.

FIG. 5 shows graphically the reheat steam temperature versus boiler load for a combustion process wherein bentonite or a Mg-based additive is added to the flame.

FIG. 6 shows graphically the furnace pressure versus boiler load for the trial periods employing bentonite or a Mg-based additive.

FIG. 7 shows graphically a comparison of the pressure difference between the furnace and the inlet to the economizer in a combustion process wherein bentonite is added to the flame versus a combustion process wherein a Mg-based additive is added to the flame.

FIG. 8 shows graphically a lower pressure drop across the economizer when the boiler is operated with bentonite as compared to when the boiler is operated with the Mg-based additive.

FIG. 9 shows graphically the air heater pressure differential as a function of time for a combustion process wherein bentonite is added to the flame versus a combustion process wherein a Mg-based additive is added to the flame.

FIG. 10 shown graphically a comparison of overall flue gas pressure drop between the furnace and the stack for the trial period employing a Mg-based additive and the period employing bentonite.

FIG. 11 compares the "frequency of occurrence" at three different boiler loads for a combustion process wherein bentonite is added to the flame versus a combustion process wherein a Mg-based additive is added to the flame.

FIG. 12 shows graphically a comparison of boiler efficiency between the trial period employing a Mg-based additive and the period employing bentonite in the combustion process as calculated by EtaPro control system.

FIG. 13 show bar charts comparing averages for conversion factor (kWh/BBl) and total power produced (GWe), during the trial period employing Mg-based additive and the trial period in which bentonite was added to the flame of the combustion process.

FIG. 14A shows bar charts comparing monthly averages for gross heat rate (BTU/kWh) during the trial period employing Mg-based additive and the trial period in which bentonite was added to the flame of the combustion process.

DESCRIPTION OF PREFERRED EMBODIMENT

Figure 14B:
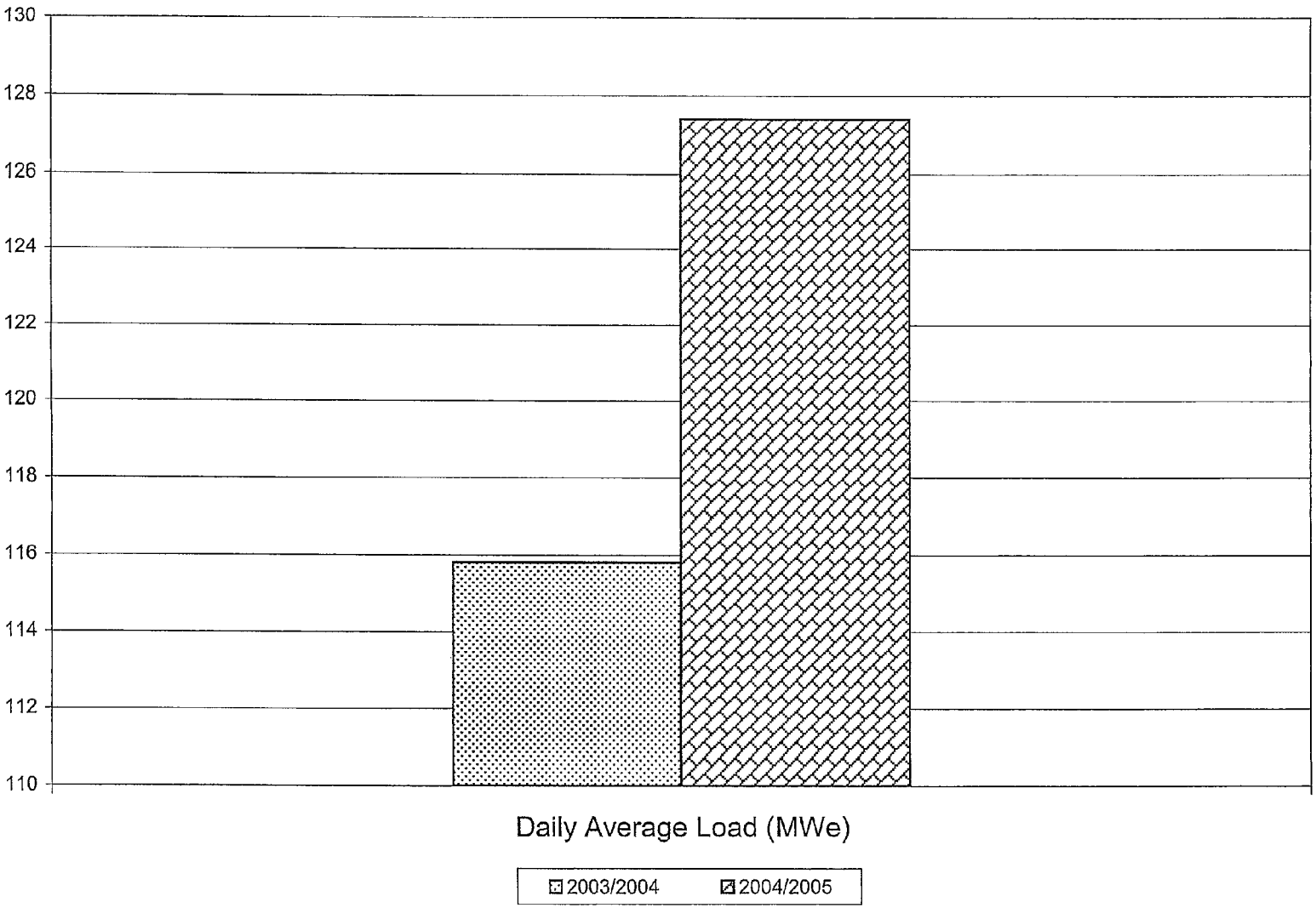
FIG. 14B shows bar charts comparing monthly averages for average boiler load during the trial period employing Mg-based additive and the trial period in which bentonite was added to the flame of the combustion process.

The present invention relates to combustion processes. More specifically, the present invention relates to increasing the efficiency of combustion processes.

The following description is of a preferred embodiment by way of example only.

According to the present invention there is provided a method of increasing the efficiency of a combustion process comprising the step of adding bentonite to the flame, fireball or burner region combustion zone during combustion of a fuel. In a preferred embodiment, which is not meant to be limiting in any manner, there is provided a method of increasing the efficiency of a combustion process comprising the step of adding bentonite the flame, fireball or burner region combustion zone during combustion of a low mineral fuel. However, alternate embodiments, as described herein are also encompassed by the present invention.

The term "increasing the efficiency of a combustion process" or "increasing the radiant heat flux of a combustion process" refers generally to increasing the radiant heat of combustion per unit of fuel. Such an increase in the efficiency of a combustion process may be demonstrated by a variety of methods known in the art, for example, but not limited to measuring an increase in boiler efficiency (%) versus load (MWe), an increase in kWh generated per unit of heat input, a reduction in Net Unit Heat Rate (kJ/kWh) as a function of Load (MWe), a reduction in Fuel Consumption (kg/s) as a function of Load (Mw), or a combination thereof. In addition, other factors may be indicative of increased efficiency, for example but not limited to an increase in hot reheat steam temperature as a function of time, an increase in hot reheat steam temperature as a function of load (MWe), a decrease in furnace pressure as a function of load (MWe), a decrease in pressure differential across various heating surfaces as a function of load (MWe) (e.g. between furnace and economizer inlet, across the economizer, etc), a reduction in the number of times the air heater must be cleaned within a given period, an increase in the daily average conversion factor (kWh/bbl), an increase in total production (GWe), or a combination thereof. Further means of demonstrating increased efficiency are described herein and are not meant to be considered limiting.

By the term "burner region combustion zone" it is meant the volume of space in proximity to the burner flame wherein combustion of a fuel occurs.

The present invention contemplates that bentonite may be added during combustion of any fuel known in the art, for example, but not limited to natural gas, propane, butane, coal, gasoline, kerosine, diesel, naptha, distillate oils, residual oils, heavy oils, wood and other biomass including biomass waste, combustible alcohols including, but not limited to ethanol and methanol, or any combination thereof.

In a preferred embodiment, which is not meant to be limiting in any manner, the fuel is a low mineral fuel. By the term "low mineral fuel" it is meant a fuel comprising less than 1% (wt/wt) non combustible mineral matter, for example, between about 0% and about 1% mineral matter, including, but not limited to 0%, 0.0001%, 0.0005%, 0.001%, 0.005%, 0.01%, 0.02%, 0.03%, 0.04%, 0.05%, 0.06%, 0.07%, 0.08%, 0.09%, 0.1%, 0.2%, 0.3%, 0.4%, 0.5%, 0.6%, 0.7%, 0.8%, 0.9%, 1% or any amount therebetween. Further, the mineral content of the fuel may comprise a range defined by any two of the values listed above or any amount therebetween.

In an alternate embodiment, which is not meant to be limiting in any manner, rather than defining the fuel as a low mineral fuel, it is contemplated that the fuel may be defined as comprising a low ash content. By the term "low ash content", it is meant a fuel comprising less than 1% ash (wt/wt), for example, between about 0% and about 1% ash, including, but not limited to 0%, 0.0001%, 0.0005%, 0.001%, 0.005%, 0.01%, 0.02%, 0.03%, 0.04%, 0.05%, 0.06%, 0.07%, 0.08%, 0.09%, 0.1%, 0.2%, 0.3%, 0.4%, 0.5%, 0.6%, 0.7%, 0.8%, 0.9%, 1% or any amount therebetween. Further, the ash content of the fuel may comprise a range defined by any two of the values listed above or any amount therebetween. In a preferred embodiment, the fuel comprises an ash content below about 0.2%, more preferably about 0.1%, more preferably still 0.05% and still more preferably below about 0.005%.

In a further embodiment of the present invention, which is not meant to be limiting in any manner, the fuel is a hydrocarbon fuel or comprises a mixture of hydrocarbons, preferably a C1-C10 hydrocarbon fuel or mixture thereof. For example, but not to be considered limiting in any manner, the fuel may comprise methane, ethane, propane, butane, pentane, hexane, heptane, octane, nonane, decane, straight chain, branched or cyclic isomers thereof, or any combination thereof. In a preferred embodiment, which is not meant to be limiting in any manner, the fuel is natural gas, propane or a mixture thereof.

In still an alternate embodiment of the present invention, which is not meant to be limiting, the fuel is a distillate oil, residual oil, heavy oil, or a combination thereof.

In still a further embodiment of the present invention, which is not meant to be limiting in any manner, the fuel is a coal, preferably a coal that comprises a low ash content upon combustion.

Combustion of fuel may take place in any suitable combustion chamber or vessel, for example, but not limited to a boiler, furnace, kiln or the like. In an embodiment of the present invention which is not meant to be limiting, the combustion process occurs in a utility boiler firing natural gas, distilate oil, residual oil, heavy oil, or a combination thereof.

In a preferred embodiment, the bentonite and the fuel are added separately to the combustion chamber. In this regard, the bentonite is not added or premixed with the fuel prior to entering the combustion chamber. However, the present invention also contemplates adding both bentonite and fuel together into the flame, fireball, or burner region combustion zone of a combustion process.

The bentonite employed in the method of the present invention may comprise sodium bentonite, calcium bentonite, or a mixture thereof. However, sodium bentonite is preferred. In a more preferred embodiment, the bentonite composition employed in the method of the present invention is characterized as comprising a light coloured particulate material, crystalline in structure that is highly swellable and that exhibits high colloidal properties. The bentonite composition comprising aluminum silicate preferably comprises one or more, or all of the characteristics shown in Table 1 as determined by X-ray fluorescence analysis.

TABLE 1

Bentonite Compositions

| Component | Wt % |
|---|---|
| $SiO_2$ | from about 51 to about 78% |
| $Al_2O_3$ | from about 13 to about 27% |
| $Fe_2O_3$ | from about 1 to about 5% |
| MgO | from about 2 to about 3% |
| CaO | from about 0.1 to 3.0% |
| $Na_2O$ | from about 1 to about 3% |
| $K_2O$ | from about 0 to about 2% |
| TiO | from about 0 to about 0.5% |
| FeO | from about 0 to about 0.5% |

Other materials may be present and not characterized or lossed on ignition (LOI) during analysis of compositions.

Moisture: preferably less than about 12% pH about 8 to about 11 at 5% solids

Specific Gravity Preferably about 2 to 3

Exchangeable Metallic Bases:

Sodium: preferably about 60 to about 65 mEq/100 g

Calcium: preferably about 10 to about 30 mEq/100 g

Magnesium: preferably about 5 to about 20 mEq/100 g

Potassium: preferably about 1 to about 5 mEq/100 g

Base/Acid ratio of between about 0.05 and about 0.2, preferably between about 0.08 and about 0.12.

Although Table 1 characterizes bentonite as comprising various components wherein each component is defined by a range of values, it is to be understood that the amount of any component as determined by X-ray fluorescence may be provided by any value within the defined range. For example, $SiO_2$ may be present in an amount from about 51 to about 78%. It is to be understood that $SiO_2$ may be present in an amount of about 51%, 55%, 60%, 65%, 70%, 75%, 78% or any amount therebetween. Further, the amount of $SiO_2$ may be defined by a range of any two of the values provided above. Similarly, $Al_2O_3$ may be present in an amount of about 13%, 15%, 17%, 19%, 21%, 23%, 25%, 27% or any amount therebetween or a range defined by any two of the values listed. $Fe_2O_3$ may be present in an amount of about 1%, 2%, 3%, 4% or about 5%, or a range defined by any two of these values. MgO may be present in an amount of about 1%, 1.5%, 2%, 2.5%, 3% or any amount therebetween, or it may be defined by a range of any two of these values. CaO may be present in an amount of about 0.1%, 0.3%, 0.5%, 0.7%, 0.9%, 1%, 1.5%, 2%, 2.5%, 3%, or any amount there between, or it may be defined by a range of any two of these values. $Na_2O$ may be present in an amount of about 0.1%, 0.3%, 0.5%, 0.7%, 0.9%, 1%, 1.5%, 2%, 2.5%, 3% or any amount therebetween or it may be defined by a range of any two of these values. $K_2O$ may be present in an amount of about 0.1%, 0.3%, 0.5%, 0.7%, 0.9%, 1%, 1.5%, 2% or any amount therebetween, or it may be defined by a range of any two of these values. $TiO_2$ may be present in an amount of about 0.1%, 0.2%, 0.3%, 0.4%, 0.5% any amount therebetween or it may be defined by a range of any two of these values. FeO may be present in an about 0.1%, 0.2%, 0.3%, 0.4%, 0.5% or any amount therebetween, or it may be defined by a range of any two of these values.

In an alternate embodiment of the present invention, the bentonite employed in the combustion process comprises at least one, more preferably all of the characteristics listed in Table 1 as determined by X-ray fluorescence:

TABLE 2

Analyses by X-ray fluorescence of bentonite samples

| Constitituent | Approx % by weight |
|---|---|
| $SiO_2$ | 60-66 |
| $Al_2O_3$ | 19-22 |
| $Fe_2O_3$ | 3-4 |
| $TiO_2$ | 0.10-0.2 |
| $P_2O_5$ | 0.03-0.08 |
| CaO | 0.4-1 |
| MgO | 1.7-2.5 |
| $SO_3$ | 0.5-0.9 |
| $Na_2O$ | 1.3-2.5 |
| $K_2O$ | 0.3-0.6 |
| BaO | 0-0.05 |
| SrO | 0.01-0.04 |
| $V_2O_5$ | <0.03 |
| NiO | 0-0.09 |
| MnO | 0.005-0.02 |
| $Cr_2O_3$ | <0.01 |
| Loss, fusion | 0-15 |

It is also contemplated that each constituent may be present in any amount within the corresponding range of values listed in Table 2.

The bentonite employed in the method of the present invention preferably comprise a particle size of between about 50 mesh and about 350 mesh, for example about 50, 75, 100, 125, 150, 175, 200, 225, 250, 275, 300, 325, 350 mesh or any value therebetween. Further, the particle size may be defined by a range of any two values listed above. In a preferred embodiment, the particle size of the bentonite is between about 100 mesh and 200 mesh. In a more preferred embodiment, the bentonite is about 150 mesh (approx. 100 microns). However, it is to be understood that the present invention also contemplates using bentonite compositions comprising a size smaller than about 350 mesh. In a specific embodiment, which is not meant to be limiting, the present invention contemplates using bentonite with a particle size of about 50 microns. In an alternate embodiment, a particle size of about 10 microns may be employed. Without wishing to be bound by theory or limiting in any manner, bentonite particles of a small size may provide increased surface area and remain entrained in the flame, fireball or burner region combustion zone for a greater duration as compared to larger particles.

The method of the present invention also contemplates employing a bentonite composition wherein about 50%, 60%, 70%, 80%, 90% or about 100% of the particles pass through the mesh size as defined above. In a specific embodiment, which is not meant to be limiting, the method employs a bentonite wherein about all of it passes through about 150 mesh.

The size of the bentonite particles that may be employed in the method of the present invention may depend upon the delivery method used to introduce bentonite into the flame, fireball or burner region combustion zone of a combustion process. Without wishing to be limiting in any manner, in an embodiment wherein bentonite is blown into the combustion chamber, the size of the bentonite particles employed may be modulated depending on the velocity of the gas used to deliver the bentonite to the flame, fireball or burner region combustion zone and vice versa. Preferably, the size of bentonite particles is selected or adjusted to ensure that they remain entrained in the gas stream for delivery to the flame, fireball or burner region combustion zone of the combustion process.

In respect of a method practiced in a kiln that employs a distillate oil or residual oil, for example a #6 oil as a fuel source in a combustion process, but without wishing to be limiting in any manner, the feed rate of bentonite to fuel may be in the range of about 1:500 to about 1:2, preferably in the range of about 1:100 to about 1:5, for example, but not limited to 1:100, 1:90, 1:80, 1:70, 1:60, 1:50, 1:40, 1:30, 1:20, 1:10, 1:5 or any ratio therebetween, more preferably about 1:50 to about 1:5, still more preferably about 1:45 to about 1:10. Alternatively, the ratio may be defined by a range of any two of the ratios listed above. However, it is also contemplated that the feed rate of bentonite to fuel may be outside that listed.

In respect of a method practiced in a utility boiler that employs a low mineral content fuel in a combustion process, but without wishing to be limiting in any manner, the feed rate of bentonite may be defined by a range of about 2 lbs/hour to about 125 pounds/hr per 150 MWe capacity of the power utility boiler, preferably about 5 lbs/hour to about 100 pounds/hr per 150 MWe capacity, more preferably about 20 lbs/hour to about 40 pounds/hr per 150 MWe capacity, for example, but not limited to about 2, 5, 10, 20, 25, 30, 40, 50, 60, 70, 75, 80, 90, 100, 110, 120 or about 125 pounds/hr per 150 MWe capacity of a power utility boiler.

In an alternate non-limiting embodiment of the present invention in which natural gas is employed as a fuel source, the feed rate of bentonite to fuel may be the same as that defined previously for a distillate oil or residual oil. However, it is also contemplated that feed rates outside the range noted may be employed in the method of the present invention.

In an embodiment wherein the fuel is a coal, but without wishing to be limiting in any manner, bentonite may be used in an amount of about 0.001% to about 50% (w/w) of the ash weight of the combusted fuel. The present invention also contemplates employing a composition comprising bentonite in an amount of about 0.005%, 0.01%, 0.05%, 0.1%, 0.15%, 0.2%, 0.25%, 0.5%, 0.75%, 1%, 2%, 3%, 5%, 10%, 20% (w/w) of the ash weight, or any percentage therebetween. The present invention also contemplates a range defined by any of the values listed herein. Preferably it is used in an amount of about 0.001% to about 50% (w/w) of the ash weight of the combusted fuel.

In an embodiment which employs a different fuel from those described above, the feed rate of bentonite to fuel may be easily determined by a person of skill in the art based on the properties of the combustion process.

The bentonite employed in the composition of the present invention may be used after it is quarried or it may be quarried and subsequently processed, treated or both. By the term "processed", it is meant bentonite that has been subjected to one or more processing steps after it has been isolated from a quarry. Processing steps may include drying, milling, crushing, pulverizing, sizing, sieving or any combination thereof. By the term "treated" it is meant that the bentonite is activated or treated with one or more chemical agents, or subjected to ion exchange, or a combination thereof. In contrast, an "untreated bentonite" is one wherein the bentonite is not activated or treated with any chemical agents. However, untreated bentonite may be processed, for example to comprise particles of a desired size or size range. Preferably, the bentonite employed in the method of the present invention is untreated bentonite.

Bentonite may be added to the flame, fireball or burner region combustion zone of a combustion process by any means known in the art, for example, but not limited to by screw auger with pneumatic feed, venturi tube, or it may be blown into the flame, fireball or burner region combustion zone in another way. It is also contemplated that the bentonite may be added to the flame, fireball or burner region combustion zone with a gas or mixture of gases such as, but not limited to air or oxygen that may used in the combustion process. In separate embodiments, the composition may be delivered by a continuous feed system, batch transfer system or a combination of both. Preferably, bentonite is continuously delivered to the flame, fireball or burner region combustion zone during combustion of a fuel.

According to a further embodiment, the present invention contemplates a boiler, furnace, kiln, or the like comprising a bentonite feed system wherein bentonite can be added to the flame, fireball or burner region combustion zone of the combustion process. In still a further embodiment, there is provided a utility plant firing one or more fuels as defined herein, wherein the utility plant comprises a bentonite feed system.

In a specific embodiment of the present invention, which is not meant to be limiting in any manner, there is provided a method of increasing the efficiency of a combustion process comprising the step of adding bentonite to the flame, fireball or burner region combustion zone during combustion of a fuel comprising natural gas. In a more preferred embodiment, the bentonite is sodium bentonite.

In an alternate embodiment of the present invention, which is not meant to be limiting in any manner, there is provided a method of increasing the efficiency of a combustion process comprising the step of adding bentonite to the flame, fireball or burner region combustion zone during combustion of a fuel comprising a distillate oil, residual oil, heavy oil or a combination thereof. In a more preferred embodiment, the bentonite is sodium bentonite.

In an alternate embodiment of the present invention, which is not meant to be limiting in any manner, there is provided a method of increasing the efficiency of a combustion process comprising the step of adding bentonite to the flame, fireball or burner region combustion zone during combustion of a fuel comprising coal. In a more preferred embodiment, the bentonite is sodium bentonite, preferably with a particle size as defined herein, more preferably about 150 mesh.

The above description is not intended to limit the claimed invention in any manner.

The present invention will be further illustrated in the following examples. However it is to be understood that these examples are for illustrative purposes only, and should not be used to limit the scope of the present invention in any manner.

EXAMPLES

Example 1

Definition of Some Terms Used to Characterize Bentonites and Analysis of Bentonite Employed in the Combustion Processes Swelling may be defined as the percentage volume increment of 2.5 g of bentonite in 100 ml of water calculated to 100 g.

Cation exchange capacity may be determined using ASTM standard test method #C 837-81 for Methylene Blue Index of Clay. In some cases, the exchangeable metallic bases may be determined by leaching with ammonium acetate.

pH and bulk density are measured under standard laboratory conditions as would be known by a person of skill in the art.

Base/acid ratio (B/A) may be determined according to the following definition:

$$\frac{B}{A} = \frac{Fe_2O_3 + CaO + MgO + Na_2O + K_2O}{SiO_2 + Al_2O3 + TiO_2}$$

Bentonite Analysis

Prior to the beginning of the tests, a sample of bentonite was analyzed. One portion of the bentonite was analyzed as is, the other was first heated to 950.degree. C. in a controlled-atmosphere furnace under oxidizing conditions.

Both samples were analyzed using X-ray fluorescence, a technique that involves forming a fused, translucent button of pre-dried sample material, at a temperature of 1000° C. In the fusing process some mineral compounds such as carbonates are volatilized, leading to a loss in weight, which is recorded as "loss on fusion". Four additional samples were analyzed.

The results, presented in Table 3, show little change in elemental composition. The bentonite that was not subjected to a combustion process suffered a "loss on fusion" of about 11%, whereas the preheated sample, having suffered an equivalent to "loss on fusion" in the controlled-atmosphere furnace, suffered a further "loss on fusion" of only about 0.24%. Each of the other constituents then showed a percentage increase roughly equivalent to the "loss on fusion" in the non-combusted sample.

TABLE 3

Analyses by X-ray fluorescence of bentonite samples

| Constituent | Sample No. (ACT) 040086[1] | 040087[2] | 040185[3] | 040186[3] | 040187[3] | 040188[3] | Avg, raw samples |
|---|---|---|---|---|---|---|---|
| | Concentration, wt % | | | | | | |
| $SiO_2$ | 60.09 | 66.86 | 61.69 | 62.26 | 64.23 | 62.83 | 62.220 |
| $Al_2O_3$ | 19.36 | 21.56 | 20.34 | 20.55 | 20.76 | 20.80 | 20.362 |
| $Fe_2O_3$ | 3.39 | 3.96 | 3.55 | 3.05 | 3.04 | 3.46 | 3.298 |
| $TiO_2$ | 0.15 | 0.17 | 0.18 | 0.15 | 0.13 | 0.16 | 0.154 |
| $P_2O_5$ | 0.043 | 0.075 | 0.048 | 0.045 | 0.047 | 0.045 | 0.046 |
| CaO | 0.84 | 0.96 | 0.73 | 0.50 | 0.61 | 0.69 | 0.674 |
| MgO | 2.16 | 2.39 | 2.05 | 1.85 | 1.82 | 2.16 | 2.008 |
| $SO_3$ | 0.83 | 0.85 | 0.79 | 0.72 | 0.67 | 0.82 | 0.766 |
| $Na_2O$ | 1.91 | 2.32 | 1.90 | 1.55 | 1.45 | 1.96 | 1.754 |
| $K_2O$ | 0.44 | 0.53 | 0.46 | 0.34 | 0.38 | 0.44 | 0.412 |
| BaO | 0.031 | 0.042 | 0.035 | <0.030 | <0.030 | 0.032 | 0.031 |
| SrO | 0.031 | 0.037 | 0.031 | 0.023 | 0.024 | 0.029 | 0.028 |
| $V_2O_5$ | <0.020 | <0.020 | <0.020 | <0.020 | <0.020 | <0.020 | <0.020 |
| NiO | <0.007 | <0.007 | 0.087 | 0.007 | <0.007 | <0.007 | <0.007 |
| MnO | 0.010 | 0.016 | 0.011 | 0.008 | 0.008 | 0.009 | 0.009 |
| $Cr_2O_3$ | <0.008 | <0.008 | <0.008 | <0.008 | <0.008 | <0.008 | <0.008 |
| Loss, fusion | 10.72 | 0.24 | 8.09 | 8.92 | 6.79 | 6.55 | 8.214 |
| Sum | 100.00 | 99.99 | 99.99 | 99.97 | 99.97 | 99.99 | 100.01 |

The base/acid ratio of the bentonite sample not subjected to combustion was calculated as $$\frac{Fe_2O_3 + CaO + MgO + Na_2O + K_2O}{SiO_2 + Al_2O_3 + TiO_2} = 0.0984$$

The base/acid ratio of the preheated sample was 0.1146.

It should be kept in mind that analyses by X-ray fluorescence are presented as oxides of the major elements, which are not necessarily the actual form of the minerals present. The original non-combusted and "preheated" samples (040086 and 040087 respectively) were therefore also subjected to analysis by X-ray diffraction, which identifies mineral species that are present in crystalline form.

Example 2

Performance Evaluation of a 175 MWe Utility Boiler Firing Residual No. 6 Oil Comparing Injection of Bentonite Versus a Mg-Based Additive into the Flame of the Burner Boiler unit #1 is a 175 MWe unit, firing residual #6 oil. It is a pressurized, tangentially-fired boiler with three elevations of burners. It has a finned-tube economizer, dual forced draft fans, and Lungstrom regenerative air heaters. The boiler cross section and its components are shown in FIG. 1.

The bentonite feed system comprises a hopper, variable screw feeder and an eductor, from which the bentonite is pneumatically conveyed to the boiler front. In the embodiment tested, which is not meant to be limiting in any manner, four injection points adjacent to the burners, at an elevation between the two top burners enabled the bentonite to be sprayed directly into the fireball.

A comparison between flame injection of bentonite versus a Mg-based additive known in the art was performed. The magnesium based additive is an oil soluble, non-abrasive, organo-magnesium fuel additive. The first trial period employed only the Mg-based additive. The Mg-based additive was added to the fuel of the combustion process. In the second trial period, only bentonite was used. Bentonite was added to the flame separately from the fuel. Within a week of using bentonite, plant operators noticed number of changes compared to use of the magnesium-based additive including, but not limited to: higher final reheat (RH) temperature, a need to tilt the burners down and much slower increases in pressure drop across the Air Heaters (AH).

Before the end of the third month of the bentonite trial period, it was concluded that compared to the Mg-based additive, bentonite injection into the flame of the burner provided:

- a significant increase in hot RH temperature, even a need to desuperheat at loads above 150 MWe, as RH temperature increased, with the burners tilted down. In previous trials with this system without bentonite, it was not possible to achieve design RH temperature at any load;
- lower pressure drop across the AH, lower furnace pressure and therefore reduced power requirements of the Forced Draft (FD) fan;
- improved energy conversion i.e. more kWh generated per unit of heat input when bentonite is injected into the flame of the boiler, with related reduction in unit heat rate and increased boiler efficiency compared to previous periods when a Mg-based additive was injected;
- no maintenance problems feeding bentonite into the boiler and no operational problems associated with the bentonite injection and delivery system.

Boiler Operating Parameters and Comparative Data Analysis

Hourly data for 76 boiler parameters was obtained for two distinct trial periods, specifically, a first trial period using a Mg-based additive and a second trial period in which bentonite was added directly to the flame of the combustion process. Daily averages of key boiler operating indicators were also recorded. A total of over 100 operating variables were analyzed. Boiler parameters are compared and reported below:

Net Unit Heat Rate (NUHR)

FIG. 2 shows the NUHR as a function of boiler load. Over the entire load range, the NUHR for combustion processes employing bentonite alone is lower than in a previous trial period using a Mg-based additive alone. That is, the trial period in which bentonite was employed demonstrated that less fuel input was required per kWh generated. Over the load range of 90 to 160 MWe the average savings was about 200-250 kJ/kWh, roughly 2.25%.

Fuel Consumption

FIG. 3 shows the difference in fuel consumption between the trial employing a Mg-based additive in the combustion process and the trial employing bentonite in the combustion process. Between 90 and 160 MWe, the fuel savings are about 0.2 to about 0.3 kg/s, with typical fuel flow rates of about 6 and about 11 kg/s for the respective boiler loads. This is another way of looking at the NUHR, and shows a similar gain. In terms of fuel cost, a reduction of 2 to 3% is substantial.

Reheat Steam Temperature

FIGS. 4 and 5 show reheat steam temperature versus time and versus boiler load, respectively. It is shown that in the period employing a Mg-based additive, the unit did not achieve reheat temperature, even with the burners tilted up. During the trial employing bentonite, the reheat temperature is consistently higher compared to the trial employing a Mg-based additive. During the trial employing bentonite in the combustion process, for boiler loads between 80 and 160, the average reheat temperature gain is between 28 and 35 deg. C. This was achieved with the burners tilted down. For boiler loads above 145 MWe, attemporating spray was required to reduce reheat steam temperature to the turbine design condition. Achieving reheat temperature is important because it increases the energy supplied to the turbine; attemporating spray further increases system efficiency because it increases steam flow by the amount of spray water injected, as per the American Society for Mechanical Engineers, Performance Test Code 4.1 (ASME PTC 4.1).

Higher reheat temperature was achieved with the burners tilted down. Making a reheat temperature is important for high cycle efficiency. For boiler loads above 145 MWe, the reheat needed to be sprayed in order to maintain turbine temperature. Desuperheating the reheat is a gain for boiler efficiency, as per ASME PTC 4.1 test code.

Furnace Pressure

FIG. 6 shows furnace pressure versus boiler load for the two trial periods. It is clear that during the period employing bentonite, the furnace pressure was lower compared to the trial period during in which a Mg-based additive was used. Again, the data for the period employing bentonite shows an advantage, a reduction in furnace pressure of about 0.5 kPa over the load range of 80 to 160 MWe. This indicates less obstruction to flue gas flow because of less ash deposition on the heat transfer surfaces. Lower furnace pressure also results in reduced FD fan power consumption and decreased plant parasitic power consumption.

Pressure Prop Between Furnace to Economizer Inlet

FIG. 7 shows a comparison of pressure difference between furnace and inlet to the economizer. During the trial in which bentonite was added to the flame, the pressure difference is consistently lower compared to the trial period employing a Mg-based additive. This is as a result of less ash deposits on the convective heating surfaces inside the boiler, when bentonite is injected.

Pressure Differential Across the Economizer

FIG. 8 shows a lower pressure drop across the economizer when the boiler is operated with bentonite as compared to when the boiler is operated with the Mg-based additive. For boiler loads between 80 and 160 MWe, the difference between the period employing a Mg-based additive and the trial period employing bentonite is between about 0.2 and 0.75 kPa. The lower pressure drop across the economizer indicates a cleaner economizer surface when bentonite is injected into the flame.

Air Heater Pressure Differential

FIG. 9 shows the air heater pressure differential as a function of time. The rate of pressure drop across the AH during the trial period employing a Mg-based additive is higher compared to the trial period employing bentonite. This suggests higher fly ash carryover to the air heater during the period employing a Mg-based additive. The graph also shows that during the trial period employing a Mg-based additive, the air heater had to be cleaned four times while during the trial period employing bentonite, there was just one AH wash, prior to the stack testing.

Overall Boiler Pressure Drop

FIG. 10 shows a comparison of overall flue gas pressure drop between the furnace and the stack for the trial period employing a Mg-based additive and the period employing bentonite. During the period employing bentonite, the overall resistance to flue gas movement inside the boiler was lower compared to the trial period employing a Mg-based additive. This is indicative of cleaner boiler internal convective surfaces, when bentonite was injected compared to when a Mg-based additive was used.

Unit Availability

FIG. 11 compares the "frequency of occurrence" at three different boiler loads. It shows how many days the unit was above 80, 100 and 140 MWe for both operating periods. The results suggest that during the period employing bentonite, the unit availability above 80, 100 and 140 MWe was higher.

Boiler Efficiency

FIG. 12 shows comparison of boiler efficiency between the trial period employing a Mg-based additive and the period employing bentonite in the combustion process. Between 80 and 160 MWe boiler loads there is an improvement in boiler efficiency between 1% and 1.5% with injection of bentonite compared to boiler efficiency when the Mg-based additive was used.

FIGS. 13 and 14 show bar charts comparing monthly averages for: conversion factor (kWh/BBl) and total power produced (GWe), gross heat rate (BTU/kWh) and average boiler load, during the trial period employing Mg-based additive and the trial period in which bentonite was added to the flame of the combustion process. During the period employing bentonite, the total electricity produced increased by about 15.2%, the monthly average boiler load was higher by about 10%, the monthly average conversion factor was about 1.9% higher and the gross monthly average unit heat rate was about 2.4% lower as shown in Table 4.

| Boiler parameters | +bentonite | +Mg-based additive | % difference |
|---|---|---|---|
| Days above 80 MWe | 111 | 90 | 23.3 |
| Days above 100 MWe | 93 | 65 | 43.1 |
| Days above 140 MWe | 39 | 14 | 78.6 |
| Total Production (GWe) | 412.8 | 358.4 | 15.2 |
| Gross Monthly Average Heat Rate (Btu/kWh) | 9737.4 | 9981.0 | -2.4 |
| Monthly Average Conversion Factor (kWh/bbl) | 665.4 | 653.0 | 1.9 |

Example 3

Figure 15:
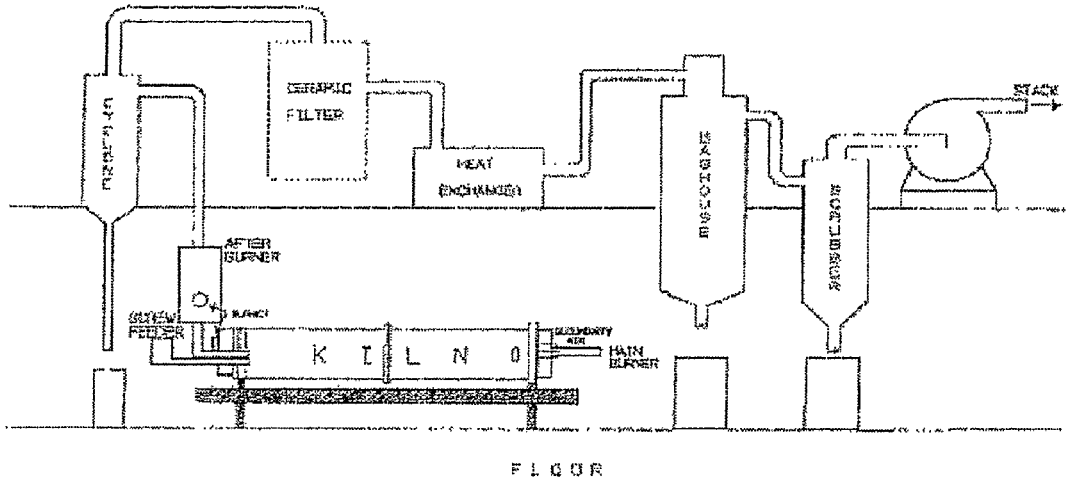
FIG. 15 shows a schematic representation of the kiln to study the addition of bentonite to the flame of a combustion process.

Evaluation of Bentonite Addition to the Flame During Firing of No. 6 Oil in a Kiln No. 6 fuel oil was fired with and without bentonite, in a pilot-scale rotary kiln. The kiln is a refractory-lined reactor 4.25 m long with an inside diameter of 0.41 m, capable of firing natural gas and fuel oil, well-instrumented for determining a range of combustion parameters. The kiln is graphically depicted in FIG. 15.

The bentonite employed in the kiln tests was pulverized to about 150 mesh (approx. 100 microns) to ensure that it remained entrained in the gas stream. It was fed at a rate approximately double the amount of ash in the No. 6 fuel oil which ranged between about 0.073% wt. and about 0.104% wt. Bentonite feeding rate was controlled with a variable speed feeder and confirmed by isokinetic determination of particulate loading in the flue gas.

First, parametric tests were performed to establish baseline conditions respectively without and with bentonite injection into the flame at the burner. Then, a set of six carbon steel SA-178A coupons was placed in the gas stream at a location where they would be exposed to temperatures below 500° C., to simulate the typical tube temperature of boiler waterwalls. Test conditions were respectively without and with bentonite injection into the flame at the burner. In a separate test series, at identical firing conditions, metal coupons made of ASTM T22 alloy were exposed to temperatures ranging from 500 to 600° C., to simulate superheater tube temperature.

The exposed metal coupons are an important part of the test program. Previous work of a similar nature, also performed in the rotary kiln, has shown that coupons with no external cooling, but oriented to face the flame, receive considerable heat by radiation from the flame, because of the high temperature differential, and radiate a small amount of heat to the kiln walls, which are only moderately cooler than the coupons. The gas stream passing over the coupons provides convective transfer tending to bring the coupons toward the gas temperature. If the coupons are close to the flame the heat they receive by radiation is likely to exceed the heat lost by radiation, and their temperature will exceed that of the gas stream. Farther from the flame, the coupons are likely to lose more heat by radiation to the walls than they gain from the flame, and their temperature may be lower than that of the gas stream. In previous work with high ash content fuels it has been found that as deposits build up on the coupons, the differential between coupon temperature and gas temperature drops; the deposits act as insulation against both heat gain and loss by radiation.

It was expected that ash deposit build up would provide an insulating effect on the test coupons, lowering their temperature. Unexpectedly, this did not happen. Instead, coupon temperature measured by thermocouples imbedded at the back of the coupons increased when bentonite was injected into the flame of the burner.

For the carbon steel, the average rate of increase was:
without bentonite: 21.52° C./h;
with bentonite: 22.58° C./h
For the T22 alloy, the average rate of increase was:
without bentonite: 24.99° C./h
with bentonite: 31.49° C./h Deposits removed from the coupons, when firing with bentonite, were found to have a composition very similar to bentonite. The deposits were fine, light and easy to remove from the coupon assembly. Table 5 shows the results of analyses of two bentonite samples by X-ray fluorescence after the sample were subjected to a combustion process.

TABLE 5

Analyses by X-ray fluorescence of deposits after firing Bentonite

| Constituent | Sample No. (ACT) 040112[1] Concentration, wt % | 040149[2] |
|---|---|---|
| $SiO_2$ | 67.49 | 64.72 |
| $Al_2O_3$ | 22.12 | 21.30 |
| $Fe_2O_3$ | 4.06 | 4.04 |
| $TiO_2$ | 0.17 | 0.16 |
| $P_2O_5$ | 0.051 | 0.094 |
| CaO | 0.88 | 1.33 |
| MgO | 2.27 | 2.47 |
| $SO_3$ | 0.47 | 2.11 |
| $Na_2O$ | 1.68 | 2.27 |
| $K_2O$ | 0.39 | 0.72 |
| BaO | <0.030 | 0.030 |
| SrO | 0.029 | 0.029 |
| $V_2O_5$ | <0.020 | 0.049 |
| NiO | 0.012 | 0.028 |
| MnO | 0.039 | 0.015 |
| $Cr_2O_3$ | 0.013 | <0.008 |
| Loss, fusion | 0.29 | 0.63 |
| Sum | 99.97 | 99.99 |

[1]Removed from bottom of kiln after firing "as received" Bentonite
[2]Removed from coupon holder after firing with Bentonite All citations are herein incorporated by reference.

The present invention has been described with regard to preferred embodiments. However, it will be obvious to persons skilled in the art that a number of variations and modifications can be made without departing from the scope of the invention as described herein.

The embodiments of the invention in which an exclusive property of privilege is claimed are defined as follows:

1. A method of increasing the efficiency of a combustion process which comprises adding bentonite to a flame, fireball or burner region combustion zone during combustion thereof in an amount sufficient to increase the efficiency of combustion compared to when bentonite is not added, wherein the bentonite comprises the following characteristics as determined by X-ray fluorescence:

| Component | Wt % |
|---|---|
| SiO2 | from about 60 to about 66% |
| Al2O3 | from about 19 to about 22% |
| Fe2O3 | from about 3 to about 4% |
| TiO2 | from about 0.1 to about 0.2% |
| P2O5 | from about 0.03 to about 0.08% |
| MgO | from about 1.7 to about 2.5% |
| CaO | from about 0.4 to about 1% |
| Na2O | from about 1.3 to about 2.5% |
| K2O | from about 0.3 to about 0.6% |
| BaO | up to about 0.05% |
| SrO | from about 0.01% to about 0.04% |
| V2O5 | less than about 0.03% |
| NiO | from about 0.005% to about 0.02% |
| MnO | less than about 0.01% |
| Cr2O3 | less than about 0.01% |
| Loss, fusion | up to about 15%. |

2. The method of claim 1, wherein a fuel to be combusted is a low mineral fuel having a mineral content that is less than about 1% by weight.

3. The method of claim 2, wherein the bentonite is added to the flame, fireball or burner region combustion zone in a combustion chamber, boiler, kiln or furnace.

4. The method of claim 2, wherein the low mineral fuel and the bentonite are added separately to the combustion zone.

5. The method of claim 2, wherein the low mineral fuel is natural gas, distillate oil, residual oil, or a combination thereof.

6. The method of claim 1, wherein the bentonite is a sodium bentonite.

7. The method of claim 1, wherein the bentonite has a particle size of about 150 mesh.

8. The method of claim 2, wherein the bentonite is added at a feed rate relative to the fuel feed rate of about 2 lbs/hour to about 125 pounds/hr per 150 MWe capacity of a power utility boiler.

9. The method of claim 1, wherein the bentonite has a base/acid (B/A) ratio of between about 0.08 and 0.12.

10. The method of claim 2, wherein the bentonite is added to the flame by a screw auger with a pneumatic feed or venturi tube.

11. The method of claim 1, wherein the fuel comprises natural gas, distillate oil, residual oil, heavy oil or a combination thereof.

12. The method of claim 1, wherein the fuel comprises coal.

13. The method of claim 12, wherein the bentonite comprises sodium bentonite having a particle size of about 150 mesh.

14. A combustion chamber comprising a flame, fireball or burner region and a bentonite feed system for feeding bentonite to the flame, fireball or burner region of the combustion chamber, wherein the bentonite comprises the following characteristics as determined by X-ray fluorescence:

| Component | Wt % |
|---|---|
| $SiO_2$ | from about 60 to about 66% |
| $Al_2O_3$ | from about 19 to about 22% |
| $Fe_2O_3$ | from about 3 to about 4% |
| $TiO_2$ | from about 0.1 to about 0.2% |
| $P_2O_5$ | from about 0.03 to about 0.08% |
| MgO | from about 1.7 to about 2.5% |
| CaO | from about 0.4 to about 1% |
| $Na_2O$ | from about 1.3 to about 2.5% |
| $K_2O$ | from about 0.3 to about 0.6% |

-continued

| Component | Wt % |
|---|---|
| BaO | up to about 0.05% |
| SrO | from about 0.01% to about 0.04% |
| $V_2O_5$ | less than about 0.03% |
| NiO | from about 0.005% to about 0.02% |
| MnO | less than about 0.01% |
| $Cr_2O_3$ | less than about 0.01% |
| Loss, fusion | up to about 15%. |

15. The combustion chamber of claim 14, wherein a boiler is a utility boiler.

16. The combustion chamber of claim 14, wherein a fuel comprises coal, natural gas, distillate oil, residual oil, heavy oil or a combination thereof, the bentonite comprises sodium bentonite having a particle size of about 150 mesh, and the bentonite is added to the flame by a screw auger with a pneumatic feed or venturi tube.

17. The combustion chamber of claim 14, wherein the bentonite has a base/acid (B/A) ratio of between about 0.08 and 0.12 and is added at a feed rate relative to a fuel feed rate of about 2 lbs/hour to about 125 pounds/hr per 150 MWe capacity of a power utility boiler.

18. A fuel additive composition comprising sodium bentonite having a particle size of about 150 mesh and the following characteristics as determined by X-ray fluorescence:

| Component | Wt % |
|---|---|
| $SiO_2$ | from about 60 to about 66% |
| $Al_2O_3$ | from about 19 to about 22% |
| $Fe_2O_3$ | from about 3 to about 4% |
| $TiO_2$ | from about 0.1 to about 0.2% |
| $P_2O_5$ | from about 0.03 to about 0.08% |
| MgO | from about 1.7 to about 2.5% |
| CaO | from about 0.4 to about 1% |
| $Na_2O$ | from about 1.3 to about 2.5% |
| $K_2O$ | from about 0.3 to about 0.6% |
| BaO | up to about 0.05% |
| SrO | from about 0.01% to about 0.04% |
| $V_2O_5$ | less than about 0.03% |
| NiO | from about 0.005% to about 0.02% |
| MnO | less than about 0.01% |
| $Cr_2O_3$ | less than about 0.01% |
| Loss, fusion | up to about 15%. |

* * * * *

UNITED STATES PATENT AND TRADEMARK OFFICE

CERTIFICATE OF CORRECTION

PATENT NO. : 8,408,148 B2
APPLICATION NO. : 12/295536
DATED : April 2, 2013
INVENTOR(S) : William T. Digdon It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1204 days.

Signed and Sealed this
First Day of September, 2015

Michelle K. Lee

Michelle K. Lee
*Director of the United States Patent and Trademark Office*